US008608914B2

(12) United States Patent
Shimamune et al.

(10) Patent No.: US 8,608,914 B2
(45) Date of Patent: Dec. 17, 2013

(54) ELECTROLYSIS SYSTEM AND METHOD

(75) Inventors: Takayuki Shimamune, Tokyo (JP); Yoshinori Takeuchi, Tokyo (JP)

(73) Assignee: Asahi Glass Co. Ltd., Tokyo (JP)

( * ) Notice: Subject to any disclaimer, the term of this patent is extended or adjusted under 35 U.S.C. 154(b) by 724 days.

(21) Appl. No.: 12/306,554

(22) PCT Filed: Jul. 5, 2007

(86) PCT No.: PCT/JP2007/063422

§ 371 (c)(1),
(2), (4) Date: Dec. 24, 2008

(87) PCT Pub. No.: WO2008/004602

PCT Pub. Date: Oct. 1, 2008

(65) Prior Publication Data

US 2009/0301895 A1 Dec. 10, 2009

(30) Foreign Application Priority Data

Jul. 7, 2006 (JP) ..... 2006-212589

(51) Int. Cl.
*C25C 3/04* (2006.01)
*C25C 7/02* (2006.01)
*C25C 7/04* (2006.01)

(52) U.S. Cl.
USPC ..... 204/247; 205/404

(58) Field of Classification Search
CPC ..... C25C 3/04; C25C 7/005; C25C 7/04
USPC ..... 204/367–410, 242–247.5; 205/242–247.5, 363–410
See application file for complete search history.

(56) References Cited

U.S. PATENT DOCUMENTS

| | | | | | |
|---|---|---|---|---|---|
| 1,545,383 | A | * | 7/1925 | Ashcroft | 204/244 |
| 1,545,384 | A | * | 7/1925 | Ashcroft | 204/244 |
| 2,959,527 | A | * | 11/1960 | De Varda | 205/389 |
| 4,334,975 | A | | 6/1982 | Ishizuka | |
| 4,401,543 | A | | 8/1983 | Ishizuka | |

(Continued)

FOREIGN PATENT DOCUMENTS

| | | |
|---|---|---|
| GB | 198024 | 5/1923 |
| JP | 51-141715 | 12/1976 |

(Continued)

OTHER PUBLICATIONS

PCT/JP2007/063422 International Search Report (Filed Jul. 5, 2007). JP Search Authority.

(Continued)

*Primary Examiner* — Nicholas A Smith
*Assistant Examiner* — Ciel Thomas
(74) *Attorney, Agent, or Firm* — Duane Morris LLP

(57) ABSTRACT

A molten salt electrolysis apparatus and a molten metal electrolyzing method using such a device are disclosed having an electrolysis vessel (4) accommodating melt electrolyte including melt metal chloride, and an electrode unit (1) having electrically conductive electrodes (8), first insulation members (9) covering upper end surfaces of the electrodes and fixed thereto while extending upward from the upper end surfaces, second insulation members (10) covering lower end surfaces of the electrodes and fixed thereto while extending downward from the lower end surfaces, and an electrode frame (12) composed of an insulating body surrounding the electrodes, the electrode unit being immersed in the melt electrolyte.

15 Claims, 12 Drawing Sheets

(56) References Cited

U.S. PATENT DOCUMENTS

| | | | | | |
|---|---|---|---|---|---|
| 4,481,085 | A | * | 11/1984 | Ishizuka | 205/404 |
| 4,592,813 | A | * | 6/1986 | Henry | 205/372 |
| 4,647,355 | A | * | 3/1987 | Ishizuka | 204/245 |
| 5,665,220 | A | * | 9/1997 | Sharma | 205/359 |

FOREIGN PATENT DOCUMENTS

| | | | |
|---|---|---|---|
| JP | 58-22385 | A | 2/1983 |
| JP | 61-113783 | A | 5/1986 |
| JP | 61-111967 | U | 7/1986 |
| JP | 11-503794 | | 3/1999 |
| JP | 2005-200758 | | 7/2005 |
| JP | 2005-200759 | | 7/2005 |
| JP | 2006-28567 | A | 2/2006 |

OTHER PUBLICATIONS

European Search Report issued Aug. 9, 2010 in counterpart EP Application No. 07768172.4.

* cited by examiner

ELECTROLYSIS SYSTEM AND METHOD

TECHNICAL FIELD

The present invention relates to an electrolysis apparatus and its related method for melt electrolyte and more particularly, to an electrolysis apparatus and its related method of electrolyzing molten metal chloride to obtain gas from an anode and melt metal from a cathode, respectively.

BACKGROUND ART

In recent years, a method of directly electrolyzing metal chloride to obtain metal and chlorine has heretofore been proposed. Unlike a production method with electrolysis conducted using an aqueous solution containing metal chloride, such a production method has characteristics of obtaining chlorine with high purity as high as 100% and metal with high purity. Thus, such a production method can be used not only for applications to the production of metal but also for collecting reduction metal used when metal is obtained from metal chloride.

More particularly, as examples of metals obtained from metal chloride, alkali metals, such as sodium, and aluminum have heretofore been known. As examples of reduction metals collected upon reducing metal chloride, further, metal such as magnesium or the like has been known for use in refining titanium from titanium chloride upon using a so-called Kroll's method.

Further, a method of obtaining high purity silicon upon reducing silicon tetrachloride with zinc using a so-called zinc reducing method enables a compact equipment to be used with low energy consumption for obtaining high purity silicon with six nines or more and hence, has been getting a lot of attention as a method of producing silicon for a solar cell demand of which is expected to rapidly expand in the future.

Although such a method is implemented under a reaction indicated by Chemical Formula 1 expressed below, a molecular weight of zinc chloride ($ZnCl_2$) is 136.4 with respect to silicon (Si) having an atomic weight of 28.1 and also, zinc chloride is produced with two molecules. This results in the production of zinc chloride with a yield about ten times that of silicon in yield, causing a serious issue to arise with the establishment of a collection processing method for zinc chloride.

$$SiCl_4+2Zn \rightarrow Si+2ZnCl_2 \quad \text{(Chemical Formula 1)}$$

The present inventors have focused attention on zinc chloride already having a melting point ranging from 283° C. to 360° C. and zinc having a melting point of 413° C. and the like, and resultantly, found a condition under which molten zinc chloride can be directly electrolyzed. More particularly, it has been found that although the melting point of zinc is higher than the melting point of zinc chloride by 100° C. or more, molten zinc chloride can be directly electrolyzed at high efficiency in a temperature range varying from 500° C. to 550° C. higher than the melting point of zinc chloride by about 200° C. or more on consideration of electric conductivity and viscosity coefficient of zinc chloride electrolyte. However, a vapor pressure of zinc chloride increases up to a level of about 0.05 atm and chlorine gas is generated accompanied by the occurrence of a large amount of mist, resulting in a tendency of causing a phenomenon to occur with the clogging of delivery pipes unless otherwise addressed.

To address such an issue, Patent Document 1, indicated below, proposes an electrolysis apparatus including electrolysis electrodes of a bipolar type to have increased electrolysis efficiency, and a demister located on an electrolysis vessel at an upper portion thereof and having the nearly same cross-sectional area as that of the electrolysis vessel for thereby lowering an uplift speed of chlorine gas containing metal mist while cooling chlorine gas during the uplift of chlorine gas to cause fine liquid droplets of zinc chloride in chlorine gas, i.e., zinc chloride mist, to drop into an electrolytic bath.

Further, Patent Document 2, indicated below, proposes an electrolysis apparatus arranged to surround electrodes with an electrode frame to keep a temperature of a surface of electrolyte at a temperature lower than an actual electrolysis temperature for thereby suppressing the occurrence of zinc chloride mist.

[Patent Document 1] Japanese Patent Application Laid-Open Publication 2005-200759

[Patent Document 2] Japanese Patent Application Laid-Open Publication 2005-200758

Problems to be Resolved by the Invention

With development of technologies set forth above, attempts have heretofore been made to effectively apply the electrolysis apparatus to a field of extracting metal not only from zinc chloride but also from the other metal. Some positive results have been accomplished to complete the electrolysis apparatus, composed of an electrolysis vessel having bipolar type electrodes with a difficulty caused to be realized in a field of electrolyzing a molten salt such as molten metal chloride, up to an actual proof level.

However, upon further study conducted by the present inventors, it may be preferable on theory to take a structure having bipolar type electrodes for the purpose of increasing electrolysis efficiency. With the use of such bipolar type electrodes, however, if a space between the electrodes is caused to decrease with a view to decreasing an ohmic loss of a region around the electrodes and increasing electrolysis efficiency, a leakage current inevitably flows from the electrodes to other areas. This results in a tendency of causing a drop in electrolysis efficiency and hence, it is recognized that there is a room for improvement in respect of such a phenomenon.

At the same time, further, a tendency is recognized with the occurrence of reverse reaction due to a contact between electrolysis product metal, produced at a vicinity of a cathode surface, and electrolysis gas, produced at a vicinity of an anode surface, and there is a room for improvement in respect of such a phenomenon.

At the same time, furthermore, electrolysis product metal tends to accumulate in an area between the electrodes. This results in a phenomenon with the occurrence of disturbing an upward flow of electrolyte or clogging the upward flow and there is a room for improvement in respect of such a phenomenon.

Moreover, merely providing the electrode frame, surrounding a circumference of the bipolar type electrodes, results in a consequence in which electrolyte easily accumulates in a region of the electrode frame. This results in recognition of a tendency with a drop in electrolysis efficiency and there is a room for improvement in respect of such a phenomenon.

The present invention has been completed upon conducting the studies mentioned above and has an object to provide an electrolysis apparatus and its related method that can realize a structure in which an ohmic loss is reduced and a leakage current is suppressed while minimizing a contact between electrolysis product metal and electrolysis product gas and causing electrolysis product metal to be rapidly discharged to an outside of an electrode frame for thereby improving current efficiency of electrolysis.

Means of Solving the Problems

To solve the above issues, a first aspect of the present invention provides a molten salt electrolysis apparatus comprising an electrolysis vessel accommodating a melt electrolyte including a melt metal chloride, and an electrode unit having electrically conductive electrodes, first insulation members covering upper end surfaces of the electrodes and fixed thereto while extending upward from the upper end surfaces, second insulation members covering lower end surfaces of the electrodes and fixed thereto while extending downward from the lower end surfaces, and an electrode frame composed of an insulating body surrounding the electrodes, the electrode unit being immersed in the melt electrolyte.

Further, with a second aspect of the present invention, the molten salt electrolysis apparatus includes the structure mentioned above and in addition thereto, the electrodes may preferably have anode surface portions and cathode surface portions, associated with the anode surface portions, wherein gas is generated at the anode surface portions and melt metal is generated at the cathode surface portions with a specific gravity higher than that of the melt electrolyte.

Furthermore, with a third aspect of the present invention in addition to the second aspect set forth above, the molten salt electrolysis apparatus may preferably have the second insulation members having flow passages through which melt metal, generated at the cathode surface portions, passes to flow down to a bottom portion of the electrolysis vessel.

Moreover, with a fourth aspect of the present invention in addition to the third aspect set forth above, the molten salt electrolysis apparatus may preferably have flow passages having inlets, provided in gap portions formed between lower end portions of the cathode surface portions and the second insulation members, respectively, to which melt metal, generated at the cathode surface portions, is introduced.

Further, with a fifth aspect of the present invention in addition to the fourth aspect set forth above, the molten salt electrolysis apparatus may preferably have at least one of chamfered corner portions, chamfered at the lower end portions of the cathode surface portions, respectively, and cutout portions, formed on the second insulation members, respectively, which are placed at the inlets of the flow passages.

Furthermore, with a sixth aspect of the present invention in addition to any one of the second to fifth aspects set forth above, the molten salt electrolysis apparatus may preferably have the first and second insulation members at least one of which has protruding portions protruding toward neighboring insulation members with respect to locations of the cathode surface portions, respectively.

Moreover, with a seventh aspect of the present invention in addition to any one of the second to sixth aspects set forth above, the molten salt electrolysis apparatus may preferably have the electrodes which are inclined in placement with respect to a vertical direction such that the anode surface portions face downward and the cathode surface portions face upward for thereby causing gas, generated at the anode surface portions, to move upward along the anode surface portions and causing melt metal, generated at the cathode surface portions, to move downward along the cathode surface portions.

Besides, with an eighth aspect of the present invention in addition to any one of the second to seventh aspects set forth above, the molten salt electrolysis apparatus may preferably have the anode surface portions and the first and second insulation members which are coplanar.

Further, with a ninth aspect of the present invention in addition to any one of the second to eighth aspects set forth above, the molten salt electrolysis apparatus may preferably have a mask member disposed between melt metal, generated at the cathode surface portions and accumulated on a bottom portion of the electrolysis vessel, and the second insulation members to suppress the occurrence of a leakage current.

Furthermore, with a tenth aspect of the present invention in addition to any one of the second to ninth aspects set forth above, the molten salt electrolysis apparatus may preferably have the electrodes are a bipolar type including a pair of end electrodes and intermediate electrodes disposed between the pair of end electrodes.

Moreover, with an eleventh aspect of the present invention in addition to any one of the second to tenth aspects set forth above, the molten salt electrolysis apparatus may preferably have the melt electrolyte that is molten zinc chloride.

Further, with a twelfth aspect of the present invention in addition to any one of the second to eleventh aspects set forth above, the molten salt electrolysis apparatus may preferably have the electrolysis vessel that is made of metal. The electrolysis vessel has an internal surface covered with a ceramic layer or graphite.

Furthermore, with a thirteenth aspect of the present invention in addition to any one of the second to twelfth aspects set forth above, the molten salt electrolysis apparatus may preferably have the first and second insulation members which are made of ceramic.

Moreover, with a fourteenth aspect of the present invention in addition to any one of the second to thirteenth aspects set forth above, the molten salt electrolysis apparatus may preferably have at least one of the first and second insulation members made of ceramic with a thickness decreasing toward a distal end.

Further, a fifteenth aspect of the present invention provides a method of electrolyzing molten salt comprising the steps of preparing a molten salt electrolysis apparatus including an electrolysis vessel accommodating melt electrolyte including melt metal chloride, and an electrode unit having electrically conductive electrodes, first insulation members covering upper end surfaces of the electrodes and fixed thereto while extending upward from the upper end surfaces, second insulation members covering lower end surfaces of the electrodes and fixed thereto while extending downward from the lower end surfaces, and an electrode frame composed of an insulating body surrounding the electrodes, the electrode unit being immersed in the melt electrolyte, and electrolyzing the melt electrolyte to cause gas to be generated at anode surface portions of the electrodes and melt metal to be generated with a specific gravity higher than that of the melt electrolyte at cathode surface portions associated with the anode surface portions while decreasing an ohmic loss in the presence of the first and second insulation members.

Effect of the Invention

With the molten salt electrolysis apparatus according to the first aspect of the present invention, providing the electrodes including the first and second insulation members enables a suppression of a leakage current while reducing an ohmic loss, without causing any disturbances to the movements of electrolysis product gas and electrolysis product metal, thereby enabling the improvement in electrolysis current efficiency. In this case, further, providing the electrode frame enables a temperature of electrolyte to be adjusted in an electrolysis reaction region in the electrode frame, thereby making it possible to achieve an effective electrolysis.

With the molten salt electrolysis apparatus according to the second aspect of the present invention, further, gas is reliably generated at the anode surface portions of the electrodes and melt metal is reliably generated at the cathode surface portions with a specific gravity higher than that of melt electrolyte, enabling electrolysis at improved current efficiency.

With the molten salt electrolysis apparatus according to the third aspect of the present invention, furthermore, melt metal, generated at the cathode surface portions, is caused to reliably flow downward through the flow passages to the bottom portion of the electrolysis vessel. This reliably prevents electrolysis product gas and electrolysis product metal from contacting each other, thereby enabling electrolysis product metal to be reliably discharged to the outside of the electrodes.

With the molten salt electrolysis apparatus according to the fourth aspect of the present invention, moreover, melt metal, generated at the cathode surface portions, can be introduced from the inlet of the flow passages to the flow passages in a reliable manner. In addition, melt metal, generated at the cathode surface portions, can be caused to flow pass through the flow passages to reliably flow downward to the bottom portion of the electrolysis vessel.

With the molten salt electrolysis apparatus according to the fifth aspect of the present invention, besides, providing at least one of the chamfered corner portions and the cutout portions enables melt metal, generated at the cathode surface portions, to be reliably introduced into the flow passages from the inlet of the flow passages.

With the molten salt electrolysis apparatus according to the sixth aspect of the present invention, further, providing the protruding portions to at least one of the first and second insulation members enables the associated insulation members to be spaced in a further decreased distance than that between the associated electrode surface portions, enabling a further reduction in leakage current. In addition, a strong electrolyte current is generated on the anode surface portions, thereby enabling electrolysis product gas and electrolysis product metal to be separated from each other in a more reliable manner.

With the molten salt electrolysis apparatus according to the seventh aspect of the present invention, furthermore, placing the electrodes at the inclined angle with respect to the vertical direction enables electrolysis product gas and electrolysis product metal to be strongly constrained to the anode surface portions and the cathode surface portions, respectively. This results in a consequence of causing a strong electrolyte stream present on the anode surface portions to effectively act on electrolysis product gas, enabling electrolysis product gas and electrolysis product metal to be separated from each other at a further rapid rate.

With the molten salt electrolysis apparatus according to the eighth aspect of the present invention, moreover, providing the anode surface portions set to be coplanar to the first and second insulation members enables product gas to move upward along the anode surface portions, making it possible to reliably prevent electrolysis product gas and electrolysis product metal from being brought into contact with each other.

With the molten salt electrolysis apparatus according to the ninth aspect of the present invention, besides, providing the masking member results in a capability of further reliably minimizing the occurrence of a leakage current due to the contribution of melt metal accumulated on the bottom portion of the electrolysis vessel.

With the molten salt electrolysis apparatus according to the tenth aspect of the present invention, further, providing the bipolar type electrodes enables electrolysis current efficiency to be further reliably improved.

With the molten salt electrolysis apparatus according to the eleventh aspect of the present invention, furthermore, using molten zinc chloride as melt electrolyte results in a capability of leading a more realistic way of a treatment of a by-product in a production of high-purity silicon based on a zinc reduction method.

With the molten salt electrolysis apparatus according to the twelfth aspect of the present invention, moreover, the electrolysis vessel is made of metal, having the inner surface coated with ceramic, or graphite. This enables the electrolysis vessel to have further increased heat resistant and corrosion resistant for accomplishing a stabilized electrolysis.

With the molten salt electrolysis apparatus according to the thirteenth aspect of the present invention, besides, the first and second insulation members are made of ceramic, thereby enabling leakage current to be suppressed in thermally stabilized manner.

With the molten salt electrolysis apparatus according to the fourteenth aspect of the present invention, in addition, at least one of the first and second insulation members has a structure with a thickness decreasing toward the distal end, enabling a lightweight to be achieved while minimizing a leakage current.

With the molten salt electrolysis method according to the fifteenth aspect of the present invention, further, using the molten salt electrolysis apparatus, including the electrodes provided with the first and second insulation members, enables a suppression of leakage current while reducing ohmic loss, so as to provide improved electrolysis current efficiency without causing any disturbance to the movements of electrolysis gas and electrolysis metal. In this case, further, the molten salt electrolysis apparatus has the electrode frame, enabling the temperature of electrolyte to be adjusted in the electrolysis reaction region in the electrode frame to effectively achieve electrolysis.

With the structure mentioned above, in summary, it becomes possible to exclude the provision of a structure that increases the space between the adjacent electrodes forming a factor to cause an increase in ohmic loss while minimizing the leakage current. At the same time, further, another effect is obtained to suppress the occurrence of a contact between electrolysis product metal and electrolysis product gas leading to the reverse reaction of electrolysis products. At the same time, furthermore, a further effect is obtained to suppress the occurrence of product metal from accumulating between the electrodes leading to the residence of electrolyte and the short-circuiting between the electrodes. In addition, by additionally providing a structure to separate electrolysis product metal by means of the flow passages, electrolysis product metal can be discharged to the region outside the electrodes at a further rapid rate, making it possible to space the electrodes in a shortened distance of, for instance, 2 mm to 3 mm.

EXPLANATION OF NUMERALS

Figure 1:
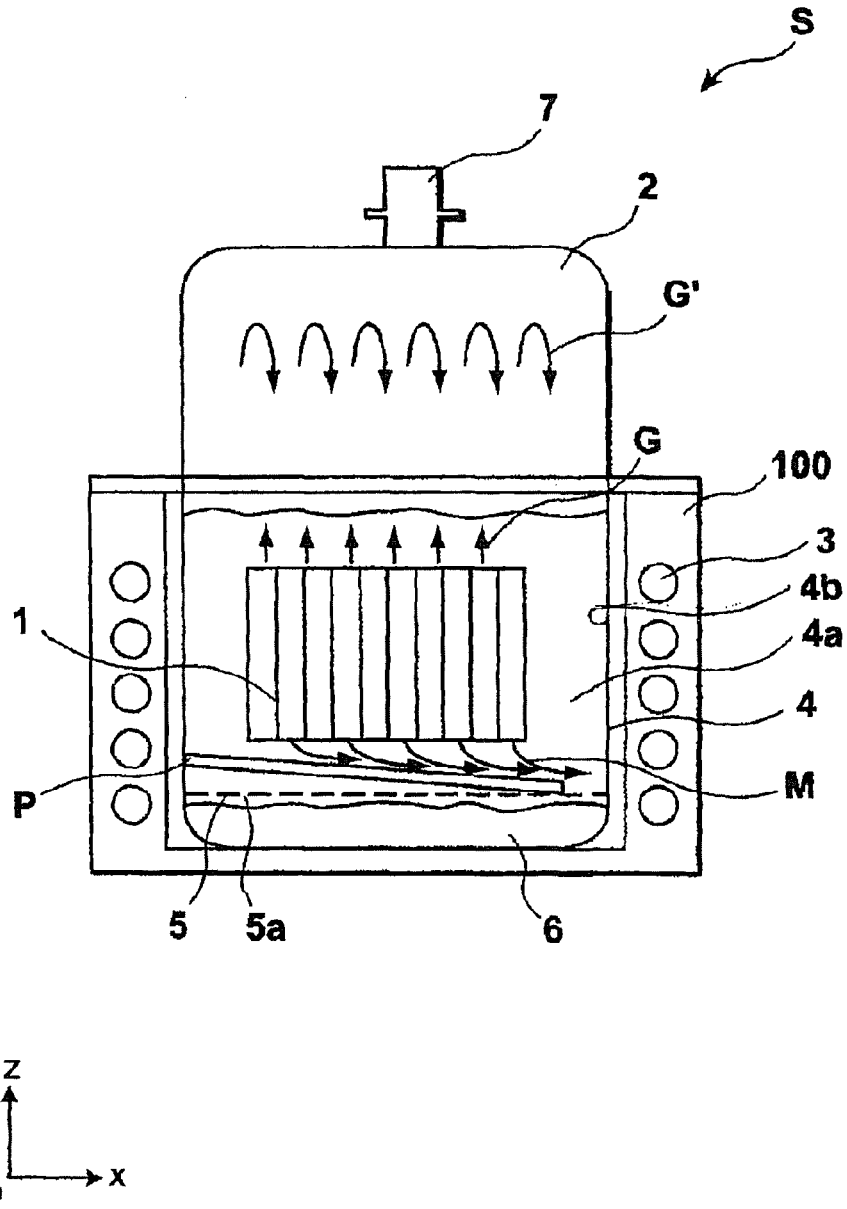
FIG. 1 is a cross-sectional schematic view of a molten salt electrolysis apparatus of an embodiment according to the present invention.

S Molten salt electrolysis apparatus
1 Electrode unit
2 Demister
3 External heater
4 Electrolysis vessel
4*a* Electrolytic bath
4*b* Ceramic film
P Plate
5 Perforated plate
5*a* Opening
6 Metal liquid pool
M Melt metal
G Electrolysis product gas
7 Gas outlet
8 Electrode
8*a* End electrode
8*b* End electrode
8*i* Intermediate electrode
9*a* Upper insulation member
9*b* Upper insulation member
9*i* Upper insulation member
9*p* Protruding portion
10 Lower insulation member
10*a* Lower insulation member
10*b* Lower insulation member
10*i* Lower insulation member
10*p* Protruding portion
11 Electrode structure body
11*a* End electrode structure body
11*b* End electrode structure body
11*i* Intermediate electrode structure body
12 Electrode frame
12*a* Sidewall
13 Electric current supply terminal
13*a* Electric current supply terminal
13*b* Electric current supply terminal
14 Anode surface portion
15 Cathode surface portion
16 Discharge flow passage
17 Gap portion
18 Discharge port
19 End cutout portion
20 Opening
21 Electrolysis vessel
22 End Electrode
23 Intermediate electrode
24 Positioning groove
25 screw
26 Perforated plate
26*a* Opening
41 Electrode unit
51 Electrode unit
61 Electrode unit
71 Electrode unit
81 Electrode unit
91 Electrode unit
100 Heating Furnace
101 Electrode unit

BEST MODE FOR CARRYING OUT THE INVENTION (Embodiment)

Now, a molten salt electrolysis apparatus and a related method of an embodiment according to the present invention will be described below with reference to the accompanying drawings. Throughout the drawings, x-, y- and z-axes represent a three-axis orthogonal coordinate system with a direction in the y-axis assigned to indicate a transverse direction and a direction in the z-axis assigned to indicate a longitudinal direction or upward-downward direction (vertical direction) while a length in the x-axis represents a thickness; a length in the y-axis represents a width; and a length in the z-axis represents a height.

Figure 2:
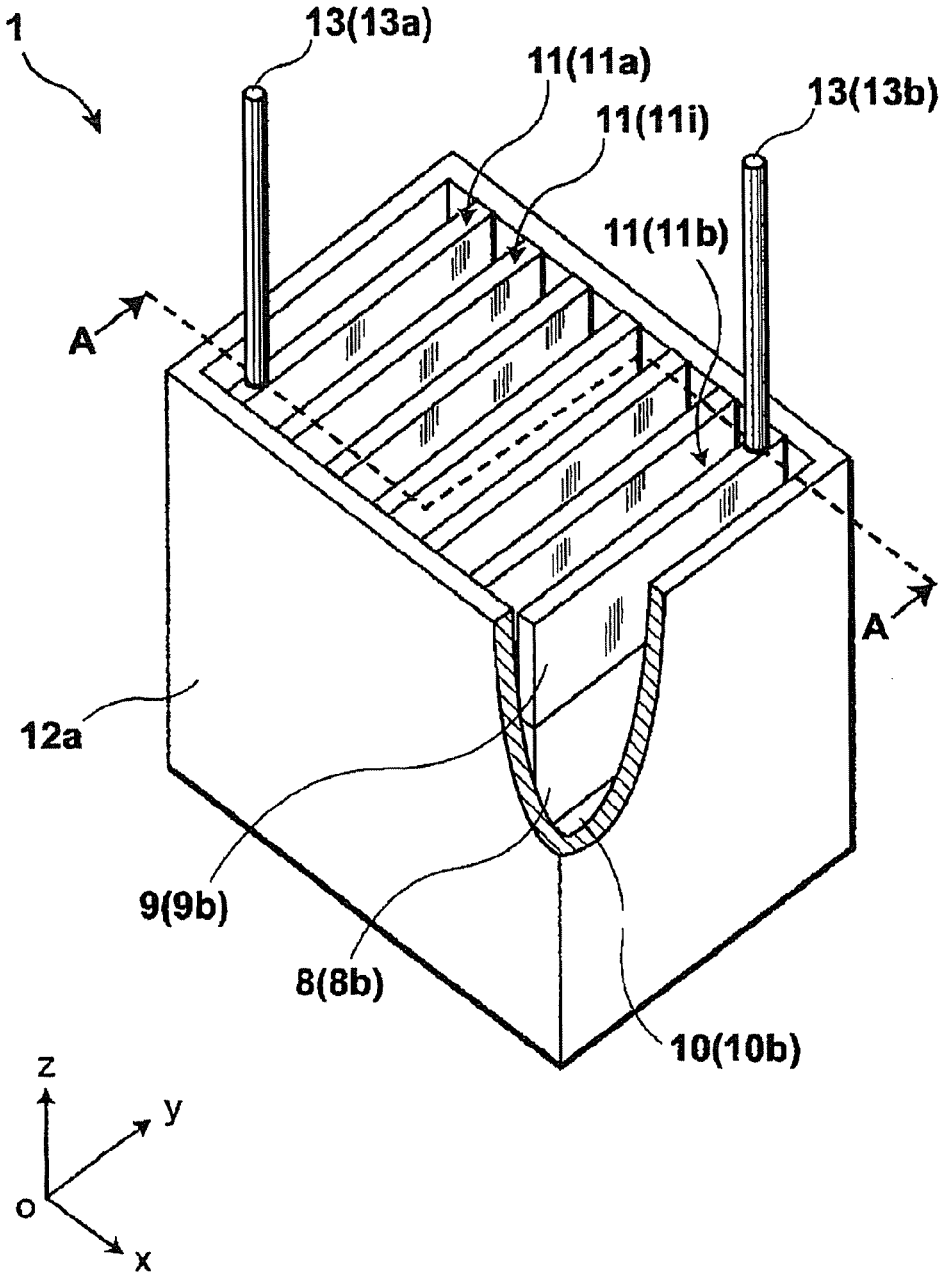
FIG. 2 is a perspective view of an electrode unit of the molten salt electrolysis apparatus according to the present embodiment.
Figure 3:
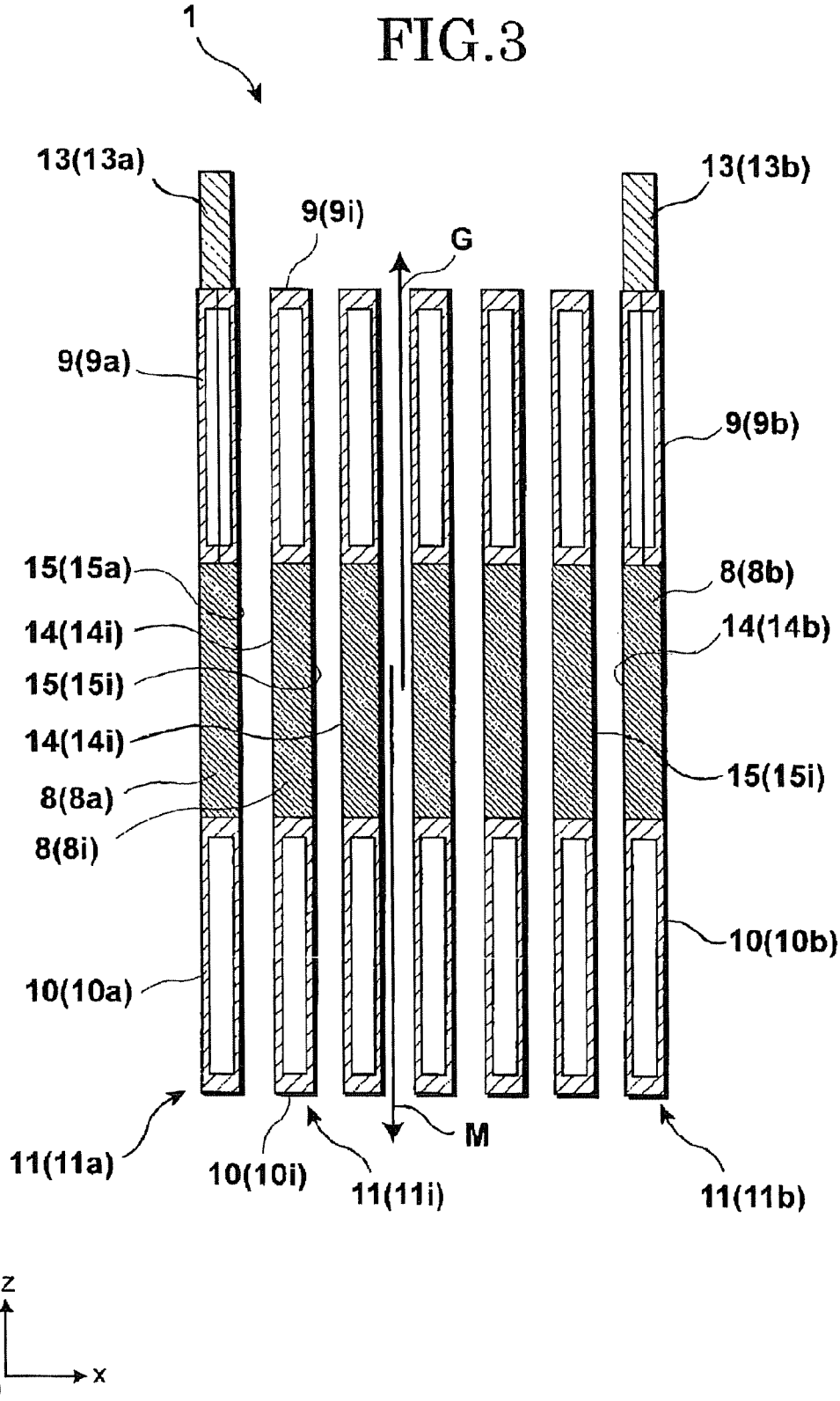
FIG. 3 is a cross-sectional view of an electrode structure body of the electrode unit of the molten salt electrolysis apparatus according to the present embodiment and corresponds to a cross-section taken on line A-A of FIG. 2.

FIG. 1 is a cross-sectional schematic view of the molten salt electrolysis apparatus according to the present embodiment according to the present invention. FIG. 2 is a perspective view of an electric unit forming a part of the molten salt electrolysis apparatus according to the present embodiment with an electrode frame shown as partly cut away in structure for a convenience of illustration. FIG. 3 is a cross-sectional view, showing an electrode structure body of the electrode unit forming a part of the molten salt electrolysis apparatus according to the present embodiment, which corresponds to a cross-sectional view taken on line A-A of FIG. 2.

As shown in FIG. 1, the molten salt electrolysis apparatus S of the present embodiment includes an electrode unit 1 and a demister 2. The electrode unit 1 is comprised of electrodes and an electrode frame, which are heated with an external heater 3, and dipped in an electrolytic bath 4*a* filled with molten salt that acts as electrolyte. An electrolysis reaction takes place in the electrolysis bath, i.e., the molten salt bath in an area close proximity to the electrodes. Although a temperature of electrolyte is of course selected to be higher than a melting point of electrolyte itself, the temperature of electrolyte is set to be higher than a melting point of metal produced upon electrolysis reaction such that electrolysis product metal is taken out as melt metal M. In addition, the external heater 3 is incorporated in a heating furnace 100 to enable electrolyte in the molten salt bath 4*a* to be heated to a desired temperature. Further, the molten salt bath 4*a* is defined in an internal space of the electrolysis vessel 4, which is made of metal and has an internal surface coated with a ceramic film 4*b* to have heat resistance and corrosion resistance adequate for accommodating heated electrolyte. Furthermore, with such properties being satisfied, it doesn't matter if the electrolysis vessel 4 is made of graphite. In addition, the electrode unit 1 is fixedly secured to the electrolysis vessel 4 by means of a support member (not shown) mounted in the electrolysis vessel 4, and the electrolysis vessel 4 is fixedly secured to the heating furnace 100 in which the external heater 3 is incorporated.

Melt metal M, produced in such an electrode unit 1, flows out of the electrode unit 1 at a bottom part thereof and passes through a plate P, which is fixedly secured to the electrolysis vessel 4 so as to remain slanted in the molten salt bath 4*a*, to be accumulated in a liquid metal pool 6 placed in a lower area of the electrolysis vessel 4. Here, the plate P is made of ceramic such as mullite and disposed between melt metal M, produced by the electrode unit 1 and accumulated in the liquid metal pool 6 in the electrolysis vessel 4 at a bottom portion thereof, and an insulation member serving as a lower structure member of the electrode unit 1 as described below in detail. This allows the plate P to function as a mask member for preventing a leakage current from flowing from the electrode unit 1 to melt metal M. In addition, a perforated plate 5 having a plurality of openings 5*a* may be provided in place of the plate P mounted at such an inclined angle. In such a case, melt metal M flows through the openings 5*a* into the liquid metal pool 6, which is placed in the bottom portion, to be accumulated for storage.

In an area over the electrode unit 1, meanwhile, electrolysis product gas G passes through a layer of liquid electrolyte to flow into the demister 2. Electrolysis product gas G', flowed into the demister 2, passes through the demister 2 in convection and is taken out of a gas outlet 7 mounted on the demister 2 at an upper end thereof.

As shown in FIGS. 2 and 3, the electrode unit 1 includes plate electrodes 8, upper insulation members 9 and lower insulation members 10, and an electrode frame 12 having a sidewall 12*a*. In particular, the electrode unit 1 takes the form of a structure including electrode structure bodies 11 composed of end electrode structure bodies 11*a* and 11*b* and intermediate electrode structure bodies 11, which include the electrodes 8 and the upper and lower insulation members 9 and 10 that are fixedly mounted on the electrodes 8 at upper and lower ends thereof so as to sandwich the electrodes 8 therein, respectively, resultantly with the electrode structure bodies 11 being juxtaposed in seven sets. In addition, the seven sets of the electrode structure bodies 11 have lateral circumferential region, excepting upper and lower regions of the electrode structure bodies 11, in such a way that the lateral circumferential region is surrounded with the electrode frame 12. With the electrode structure bodies 11 having the lateral circumferential region surrounded with the electrode frame 12 in such a way, the electrode frame 12 can act as a heat-insulating member. This enables an internal part of the electrode unit 1, achieving an electrolysis reaction, to be maintained at a higher temperature than that of the other area of the molten salt bath 4*a* such that an electrolysis voltage is decreased. In addition, a surface of liquid electrolyte has a lower temperature than that of the inside of the molten salt bath 4*a*. This causes fine liquid droplets of electrolyte, i.e., mist of electrolyte, to be less generated. Here, the electrode frame 12 preferably surrounds at least a region causing electrolysis reaction to take place with the electrode structure bodies 11. From that viewpoint, the sidewall 12*a* of the electrode frame 12 may preferably have a height available to surround at least the electrodes 8. In addition, the electrodes 8 may be preferably made of graphite, and the upper and lower insulation members 9 and 10 and the electrode frame 12 may be preferably made of ceramic in view of electrical and temperature characteristics and a production basis. Further, the electrodes 8 may be preferably formed with internal hollow areas, respectively, to achieve a reduction in weight in the sense. Moreover, although the present embodiment has been described above with reference to the structure of a bipolar type with the electrode unit 1 including the seven sets of the electrode structure bodies 11, i.e., seven sheets of electrodes 8, the number of such electrodes may be suitably determined to meet a required electrolysis performance and a kind of electrolyte.

More particularly, the electrodes 8 include end electrodes 8*a* and 8*b*, placed on both ends, and five sheets of intermediate electrodes 8*i* disposed between the end electrodes 8*a* and 8*b*, respectively. The upper insulation members 9 include end insulation members 9*a* and 9*b*, placed on both ends, and five sheets of intermediate insulation members 9*i* disposed between the end insulation members 9*a* and 9*b*. The lower insulation members 10 include end insulation members 10*a* and 10*b*, placed on the both ends, and five sheets of intermediate insulation members 10*i* disposed between the end insulation members 10*a* and 10*b*.

The seven sheets of electrodes 8*a*, 8*b* and 8*i* have upper ends to which the seven sheets of the upper insulation members 9*a*, 9*b* and 9*i* are fixedly attached. Likewise, the seven sheets of electrodes 8*a*, 8*b* and 8*i* have lower ends to which the seven sheets of the lower insulation members 10*a*, 10*b* and 10*i* are fixedly attached. The upper insulation members 9*a*, 9*b* and 9*i* are provided to avoid a leakage current from occurring from one of the electrodes 8*a*, 8*b* and 8*i* to the other electrodes, which are not proximal thereto, through upper regions of neighboring electrode proximal to the one of the electrodes 8*a*, 8*b* and 8*i*, i.e., for instance, from any one of the electrodes 8*a*, 8*b* and 8*i* to next but one electrode. Particularly, the upper insulation members 9*a*, 9*b* and 9*i* extend upward so as to cover upper end surfaces of the electrodes 8*a*, 8*b* and 8*i* (i.e., end surfaces parallel to the x-y plane). Likewise, further, the lower insulation members 10*a*, 10*b* and 10*i* extend downward so as to cover lower end surfaces of the electrodes 8*a*, 8*b* and 8*i* (i.e., end surfaces parallel to the x-y plane).

Further, the end electrodes 8*a* and 8*b* are connected to electric current supply terminals 13, i.e., the electric current supply terminals 13*a* and 13*b* passing through the associated upper insulation members 9*a* and 9*b*, respectively. This allows electrolysis current to be supplied to the end electrodes 8*a* and 8*b* from a D.C. power supply (not shown) through the electric current supply terminals 13*a* and 13*b*.

With the electrolysis current supplied in such a way, each electrode 8 has one surface acting as an anode surface portion and the other surface acting as a cathode surface portion. In particular, the end electrode 8*a* has a cathode surface portion 15*a* that is a plane placed on the side of the x-positive direction in the end electrode 8*a* (i.e., a plane parallel to the y-z plane), and the intermediate electrode 8*i*, proximal to the end electrode 8*a* in the x-positive direction, has an anode surface portion 14*i* that is a plane facing such a cathode surface portion 15*a* (i.e., a plane parallel to the y-z plane). Thus, in such a way, the intermediate electrodes 8*i*, adjacent to each other, have the cathode surface portions 15*i* and the anode surface portions 14*i* sequentially placed in face-to-face relation to each other. With the end electrode 8*b* and the intermediate electrode 8*i* proximal to the end electrode 8*b*, the end electrode 8*b* has an anode surface portion 14*a* that is a plane on the side of the x-negative direction in the end electrode 8*b* (i.e., a plane parallel to the y-z plane), and the intermediate electrode 8*i*, proximal to the end electrode 8*b* in the x-negative direction has a cathode surface portion 15*i* that is a plane facing such an anode surface portion 14*a* (i.e., a plane parallel to the y-z plane).

Then, electrolysis product gas G is generated at vicinities of the anode surface portions 14 and moves upward, with melt metal M being generated in the form of electrolysis product metal at vicinities of the cathode surface portions and moves downward. The upper insulation members 9 have one surfaces, lying on the anode surface portions 14, respectively, and the other surfaces, lying on the cathode surface portions 15, respectively, which are set to be coplanar to the anode surface portions 14 and the cathode surface portions 15, respectively. Thus no upward movement of electrolysis product gas G is disturbed. The lower insulation members 10 have one surfaces, lying on the cathode surface portions 15, respectively, and the other surfaces, lying on the anode surface portions 14, respectively, which are set to be coplanar to the cathode surface portions 15 and the anode surface portions 14, respectively. Thus, no downward movement of melt metal M, present as electrolysis product metal, is disturbed, resultantly enabling electrolysis product gas G and melt metal M to reliably move to an outside of the electrode unit 1, respectively.

If specific gravities of melt metal M, generated at the vicinities of the cathode surface portions 15, and electrolyte do not remain in a comparatively large difference, there is a tendency in which cathode product metal M takes the form of metal mist with a lot of fine liquid droplets being present in electrolyte. In this case, it is recognized that heated electrolyte has a strong upward flow with an effect of suppressing the diffusion of metal mist in electrolyte. This avoids a reduction in electric current efficiency, i.e., degradation in an electrolysis efficiency caused by a reverse reaction between electrolysis product gas G and electrolysis product metal M. Particularly, since the lower insulation members 10 and the upper insulation members 9 have the surfaces in line with the anode surface portions 14 of the electrodes 8, respectively, and such surfaces of the lower insulation members 10 and the upper insulation members 9 are coplanar to the anode surface portions 14, the strong upward flow of heated electrolyte is not disturbed and resultantly, undesired dispersion of metal mist into electrolyte can be restrained. In addition, the upward flow of such electrolyte provides an increased gas lifting effect to electrolysis product gas G, enabling electrolysis product gas G to be rapidly exhausted from the electrode unit 1 to an upper outside area.

On directly electrolyzing metal salt representative of zinc chloride, gas G like chlorine gas is generated at the vicinities of the anode surface portions 14 and melt metal M is generated at the vicinities of the cathode surface portions 15. Here, it is confirmed that during such a direct electrolysis, in order to decrease a leakage current while reducing an ohmic loss of electrolyte for thereby lowering an electrolysis voltage, it is effective for the electrodes 8 to be spaced in a decreased distance, i.e., for the anode surface portions 14 and the cathode surface portions 15, facing each other, to be spaced in a reduced distance while providing the large insulation members 9 and 10 on the electrodes 8 at both the upper and lower ends thereof, respectively. As one example, in manufacturing zinc and chlorine upon direct electrolysis of zinc chloride, with a relatively large difference in specific gravity between electrolyte and electrolysis product metal, the electrodes 8 were prepared each with a size of 300 mm-by-300 mm in height and width with a thickness of 25 mm. The insulation members 9 and 10, each having the same size as that of each electrode 8, i.e., 300 mm-by-300 mm in height and width, were mounted on the electrodes 8 at upper and lower walls thereof, respectively. The electrodes 8 were spaced from each other, i.e., the anode surface portions 14 and the cathode surface portions 15, facing each other, were spaced by a distance of 5 mm (under which the upper and lower insulation members 9 and 10, facing each other, were spaced by a distance of 5 mm). Under such a structure, the leakage current could be reduced to a value of 5% one-half or less of that of a structure in which none of the upper and lower insulation members are used. Even if the electrodes 8 were spaced in distance by 3 mm (with the associated insulation members 9 and 10 being spaced in distance by 3 mm) with a view to minimizing the ohmic loss, the leakage current remained intact to be about 5%, enabling the electric current efficiency of 90% or more to be obtained with a high current density as high as an electric density of 50 A/dm$^2$. This is conceived to be derived from the fact that the electrodes 8, having the upper and lower insulation members 9 and 10 so as to cover the upper and lower areas of the electrode 8, respectively, are spaced from each other in distance as small as possible, i.e., in particular, from 5 mm to about 3 mm to effectively decrease the leakage current from the electrodes 8 to the upper and lower areas thereof with a resultant reliable reduction in ohmic loss.

In theory, the longer the longitudinal length, i.e., the height, of the insulation members 9 and 10, the greater will be the effect of suppressing the leakage current. However, making an attempt to unduly increase the height causes the electrode unit 1 to be large in size and there is a need to use the electrolyte cell 4 with a large capacity. If the insulation members 9 and 10 having the heights reduced to a value as high as 60 mm, the leakage current increases by a value of nearly 60% in contrast to a structure in which the height is set to a value of 300 mm but the electrode unit 1 has a height less than one-half. That is, the heights of the insulation members for effectively decreasing the leakage current need to be determined in balance with a leakage current decreasing effect and a size of the electrode unit 1 and in this case, the heights of the insulation members should be determined on consideration of a kind of metal salt, the distance between the electrodes 8 and widths of the electrodes 8, etc. With the present embodiment, further, the insulation members 9 and 10 have structures made of members independent from that of the electrodes 8 and hence, the heights and widths of the insulation members 9 and 10 can be determined with increased freedom of design.

As set forth above, with the upper and lower insulation members 9 and 10 mounted on the electrodes 8, respectively, with the electrodes 8 spaced in a decreased distance, the electrode unit 1 can have an increased current efficiency even in decreasing the electrolysis voltage. Further, with the electrodes 8 spaced in a further decreased distance and the insulation members 9 and 10 placed on planes coplanar to the anode surface portions 14 and the cathode surface portions 15, respectively, electrolysis product gas G and electrolysis product metal M can be immediately caused to move to the outside without causing any undesired dispersion of metal mist.

Next, various modified examples of the electrode unit of the molten salt electrolysis apparatus S according to the present invention will be described below in detail with appropriate reference to the accompanying drawings. The various modified examples take the same structure as that of the present embodiment set forth above except for a structure unless otherwise indicated and thus, related description will be omitted herein.

Figure 4:
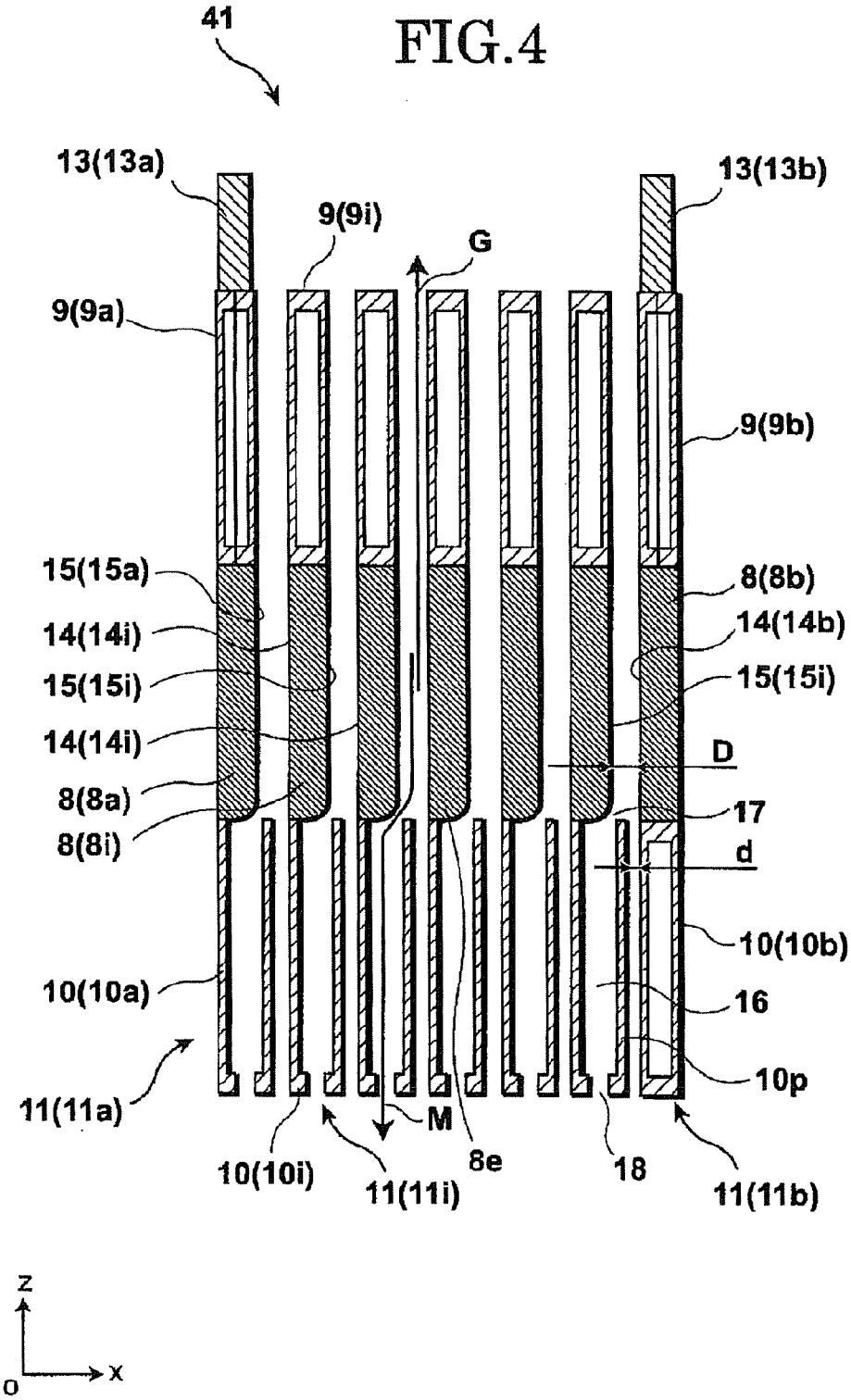
FIG. 4 is a cross-sectional view of an electrode structure body of an electrode unit of a first modified example according to the present embodiment and corresponds to the cross-section taken on line A-A of FIG. 2.
Figure 5:
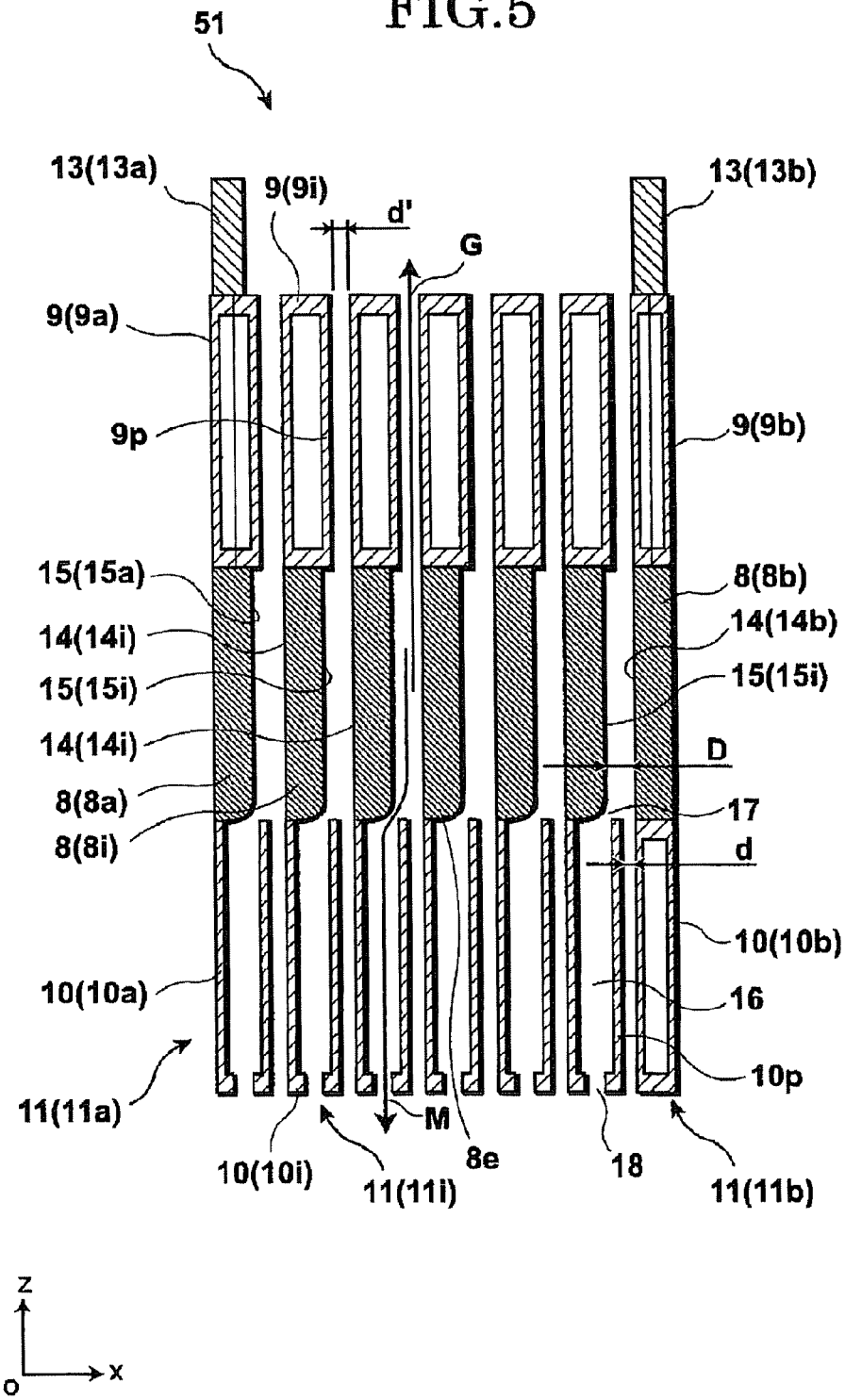
FIG. 5 is a cross-sectional view of an electrode structure body of an electrode unit of a second modified example according to the present embodiment and corresponds to the cross-section taken on line A-A of FIG. 2.
Figure 6:
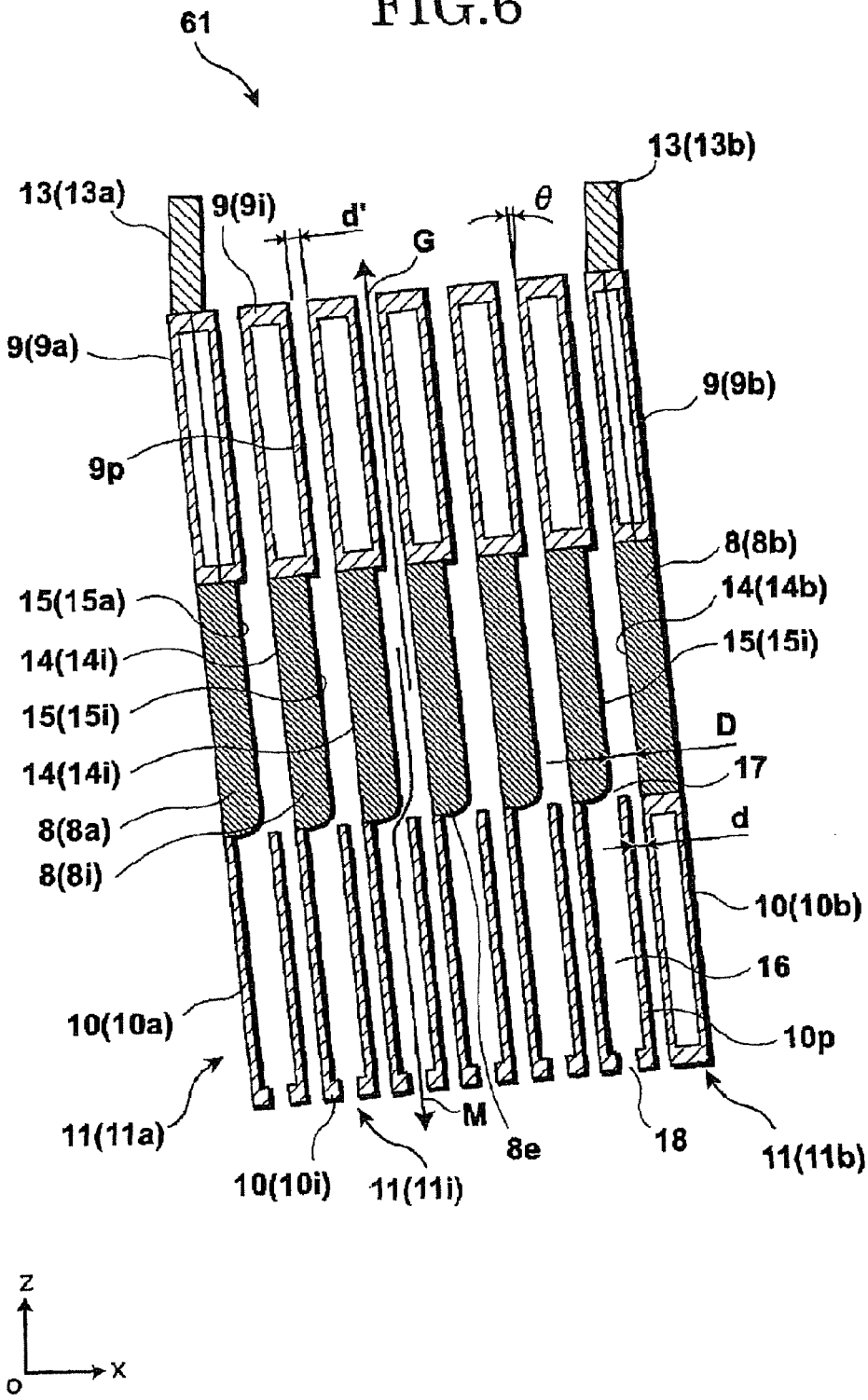
FIG. 6 is a cross-sectional view of an electrode structure body of an electrode unit of a third modified example according to the present embodiment and corresponds to the cross-section taken on line A-A of FIG. 2.
Figure 7:
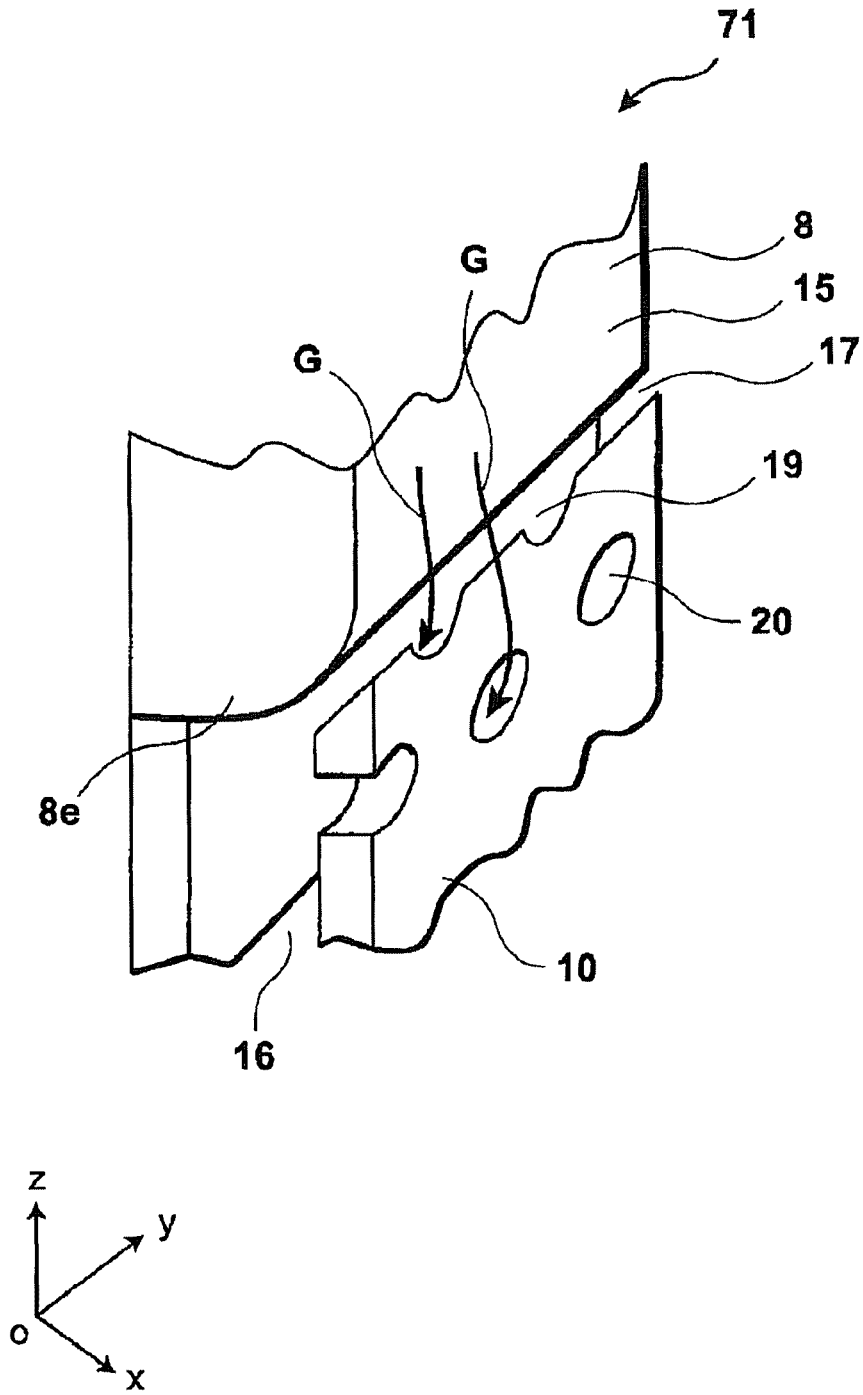
FIG. 7 is an enlarged view in a vicinity of an inlet port, placed for cathode product metal, of an electrode unit of a fourth modified example according to the present embodiment.

FIG. 4 is a cross-sectional view of an electrode structure body of an electrode unit of a first modified example according to the present embodiment and corresponds to the cross-sectional view taken on line A-A of FIG. 2. Further, FIG. 5 is a cross-sectional view of an electrode structure body of an electrode unit of a second modified example according to the present embodiment and corresponds to the cross-sectional view taken on line A-A of FIG. 2. Furthermore, FIG. 6 is a cross-sectional view of an electrode structure body of an electrode unit of a third modified example according to the present embodiment and corresponds to the cross-sectional view taken on line A-A of FIG. 2. FIG. 7 is an enlarged view of a vicinity of a guide inlet of an electrode unit of a fourth modified example according to the present embodiment for introducing cathode product metal.

FIRST MODIFIED EXAMPLE

An electrode unit 41 of the first modified example of the present embodiment shown in FIG. 4 differs from the structure of the electrode unit shown in FIG. 3 mainly in that the lower insulation members 10 have discharge flow passages 16, respectively, each extending in the vertical direction.

As set forth above, upon electrolysis reaction, electrolysis product gas G is generated at the anode surface portions 14 and moves upward whereas melt metal M in the form of electrolysis product metal is generated at the cathode surface portions and moves downward. Upon further study, if an attempt is made to mount the insulation members 9 and 10 on the electrodes 8, respectively, and allow the electrodes 8 to be spaced from each other with a progressively decreasing distance, an ohmic loss and a leakage current decrease with a resultant decrease in electrolysis voltage. However, resulting melt metal M tends to adhere to surfaces of the cathode surface portions 15 at lower ends thereof and surfaces of the lower insulation members 10 in thick, depending on wetting properties of resulting metal to the electrodes 8 and the insulation members 9 and 10 or viscosity of resulting metal per se. Adhered metal has a tendency to disturb the upward flow of electrolyte, which would contribute to rapid removal and upward flow of electrolysis product gas G from the anode surface portions 14, and to cause a short-circuiting between he electrodes 8. Further, gas G in the form of anode product and metal M in the form of cathode product are brought into contact with each other to cause reverse reaction. Thus, there is an increasing tendency of causing degradation in electric current efficiency. In order to address such an issue, a structure may be more preferably added to prevent electrolysis product metal M from adhering onto the cathode surface portions 15 while preventing electrolysis product metal M from disturbing the upward flow of electrolyte.

With the present modified example, the electrodes 8 have lower ends that are chamfered on slants or on curved surfaces at chamfered corner portions 8*e*, respectively, and the lower insulation members 10 have internal parts through which discharge flow passages 16 extend each in the vertical direction. With the electrodes 8 having the lower ends formed with the chamfered corner portions 8*e* in such a way, the discharge flow passages 16 of the lower insulation members 10 have upper ends defined with gap portions 17, respectively, which act as inlet ports through which melt metal M is introduced into the discharge flow passages 16. Accordingly, melt metal M, resulting from electrolysis, passes through the gap portions 17 into the discharge flow passages 16 of the lower insulation members 10, from which melt metal M flows into lower areas of the discharge flow passages 16 to be discharged through outlet ports 18 formed on the lower insulation members 10 at lower ends thereof, respectively. In addition, the end electrode 8*b* has no cathode surface portion 15 and hence, the chamfered corner portion 8*e* can be omitted. This enables the flow passage 16 to be omitted from the lower insulation member 10 associated with the end electrode 8*b*.

With the lower insulation members 10, each having at least the same thickness as that of each electrode 8, which are internally formed with the discharge flow passages 16 for admitting electrolysis product metal M, electrolysis product metal M is rapidly introduced into the insides of the lower insulation members 10 from the electrodes 8 and from the lower insulation members 10, between which the upward flow of electrolyte passes from the lower insulation members 10, respectively. That is, rapidly introducing electrolysis product metal M into the lower insulation members 10 ensures an upward flow path for electrolyte to pass between the lower insulation members 10 and between the electrodes 8, enabling an upward flow speed of an electrolyte stream to be maintained at a high level. With such an upward flow speed, resulting anode gas G further effectively has a gas lift effect due to a strong upward flow of electrolyte and is rapidly discharged to an upper area from the electrode unit 41. In addition, when metal M, generated at the cathodes, and electrolyte have specific gravities with a difference that is not comparatively large, cathode product metal M generates metal mist that is dispersed as fine liquid droplets in electrolyte. However, the presence of such a strong upward flow of electrolyte minimizes the occurrence of dispersion of metal mist into electrolyte. This enables to prevent a reduction in electric current efficiency, i.e., electrolysis efficiency, which occurs due to a reverse reaction caused between electrolysis product gas G and electrolysis product metal M.

Further, upon making a study on the distance between the lower insulation members 10, the lower insulation members 10 may preferably include protruding portions 10*p*, respectively, which jut toward the proximal neighboring lower insulation members 10 so as to protrude with respect to the positions of the cathode surface portions 15 of the electrodes 8, respectively, with a view to achieving a reduction in leakage current. With such protruding portions 10*p* being provided, a distance d between the lower insulation members 10 become shorter than a distance D between the electrodes 8 to narrow the flow path of leakage current tending to flow through the lower regions of the electrodes 8. If an attempt is merely made to narrow the distance between the lower insulation members 10, then electrolysis product metal M disturbs the upward flow of electrolyte. However, with the lower insulation members 10 internally provided with the discharge flow passages 16 for electrolysis product metal M, respectively, no electrolysis product metal M flows downward between the lower insulation members 10 but electrolysis product metal M passes through the discharge flow passages 16, thereby preventing the occurrence of an adverse affect on the upward flow of electrolyte. In addition, the end electrode 8*b* has no cathode surface portion 15 and hence, the protruding portion

10*p* can be omitted from the lower insulation member 10*b* associated with the end electrode 8*b*.

With the lower insulation members 10 spaced in such a narrowed distance, further, a surface of each lower insulation member 10, placed on the same side as the anode surface portion 14, may be preferably coplanar with the anode surface portion 14 of each electrode 8. This is because the coplanar structure results in an effect of causing the strong upward flow of electrolyte to reliably flow along the anode surface portions 14 for enabling anode product gas G to be efficiently transferred upward while reliably preventing melt metal M, generated at the cathode surface portions 15, from dispersing into liquid to minimize a reduction of electrolysis efficiency caused by the production of metal mist.

With the structure of the present modified example, as set forth above, providing the lower insulation members 10 internally formed with the discharge flow passages 16, respectively, allows electrolysis product metal M to be rapidly discharged. In addition, spacing the lower insulation members 10 in a further narrowed distance enables the suppression of leakage current to keep a high current efficiency. Moreover, permitting one surface of each lower insulation member 10 to be coplanar enables electrolyte and electrolysis product gas G to rapidly flow upward.

SECOND MODIFIED EXAMPLE

An electrode unit 51 of a second modified example of the present embodiment, shown in FIG. 5, differs in structure from the electrode unit 41 of the first modified example, shown in FIG. 4, mainly in that the upper insulation members 9 have one sides formed with protruding portions 9*p*, respectively, which jut toward the proximal neighboring upper insulation members 9 so as to protrude with respect to the cathode surface portions 15 of the electrodes 8, respectively. In addition, the end electrode 8*b* has no cathode surface portion 15 and hence, the protruding portion 9*p* can be omitted from the upper insulation member 9*b* associated with the end electrode 8*b*. Of course, further, such protruding portions 9*p* of the upper insulation members 9 may be provided in the electrode unit 1 shown in FIG. 3.

With such a structure of the present modified example, like the structure determined in the lower insulation members 10 of the first modified example, a distance d' between the upper insulation members 9 is made smaller than the distance D between the electrodes 8. This enables a reduction in leakage current without causing any disturbance on the upward flow of anode product gas G along the anode surface portions 14. With the upper insulation members 9 provided with the protruding portions 9*p*, respectively, further, the upper insulation members 9 have the sides deviated toward the anode surface portions 14, respectively, to allow electrolyte to have stronger upward flow flowing along the anode surface portions 14 with an increased gas-lift effect, thereby promoting the upward flow of anode product gas G. In addition, the flow of electrolyte is defined as an upward flow component close only to the anode surface portions 14. Thus, gas bubbles, accompanied by the generation of anode product gas G, are not dispersed on the cathode surface portions 15, resulting in the same effect as that in which barrier membranes are located between the anode surface portions 14 and the cathode surface portions 15.

With such a structure of the present modified example, both of the distance between the upper insulation members 9 and the distance between the lower insulation members 10 are determined to be short with a consequence of minimizing leakage current, making it possible to keep an increased electric current efficiency even if current density is increased. As one example, in manufacturing zinc and chlorine upon direct electrolysis of zinc chloride with a relatively large difference in specific gravity between electrolyte and electrolysis product metal, the electrodes 8 were prepared each with a size of 300 mm-by-300 mm in height and width with a thickness of 25 mm. The insulation members 9 and 10, each having the same size as that of each electrode 8, i.e., 300 mm-by-300 mm in height and width, were mounted on the electrodes 8, respectively. The electrodes 8 were spaced from each other, i.e., the anode surface portions 14 and the cathode surface portions 15, facing each other, were spaced by a distance of 5 mm under which the upper insulation members 9 and the lower insulation members 10 were spaced each by a distance of 3 mm. Under such a structure, a current efficiency of about 90% could be obtained with high current density of 50 A/dm$^2$.

THIRD MODIFIED EXAMPLE

An electrode unit 61 of a third modified example of the present embodiment, shown in FIG. 6, differs in structure from the electrode unit 51 of the second modified example, shown in FIG. 5, mainly in that the electrodes 8 and the upper and lower insulation members 9 and 10, associated with the electrodes 8, respectively, are inclined by an angle θ with respect to the vertical direction such that the anode surface portions face downward and the cathode surface portions face upward. In addition, such inclining placements of the electrodes 8 may be applied to the electrode units 1 or 41 shown in FIG. 3 or FIG. 4.

With such a structure, slightly inclining the cathode surface portions 15 of the electrodes 8 so as to face upward enables electrolysis product gas G and electrolysis product metal M to be strongly constrained toward the anode surface portions 14 and the cathode surface portions 15, respectively. That is, anode product gas G is subjected to a force acting upward due to a buoyant force and lifts up along the anode surface portions 14 to be expelled to the outside of the electrode unit 61. Meanwhile, electrolysis product metal M is subjected to a force directed downward due to a gravity force to move downward along the cathode surface portions 15. That is, such a structure results in a reduction in a contact probability between electrolysis product gas G and electrolysis product metal M, and electrolysis product gas G and electrolysis product metal M move along the anode surface portions 14 and the cathode surface portions 15, respectively, thereby enabling the suppression of the dispersion of metal mist. Here, if the electrodes 8 and the upper and lower insulation members 9 and 10 are disposed in the vertical direction, then the electrode unit 61 has no such an effect. However, if these component members have excessively increased inclining angles, then the upward flow of electrolysis product gas G and the downward flow of electrolysis product metal M are disturbed. Therefore, the inclining angles of the electrodes 8 and the upper and lower insulation members 9 and 10 need to be determined inconsideration of a kind of electrolyte, a kind of electrolysis product metal and a kind of electrolysis product gas. In electrolyzing molten salt with zinc chloride, the inclining angles are determined in a value raging from 3° to 10° with a view to exhibiting such an effect.

FOURTH MODIFIED EXAMPLE

Next, an electrode unit 71 of a fourth modified example of the present embodiment, shown in FIG. 7, differs in structure from the electrode unit 51 of the second modified example, shown in FIG. 5, mainly in that the lower insulation member 10 has a portion, on the side of the cathode surface portion 15, which is formed with end cutout portions 19 and openings 20 at a position in the vicinity of the gap portion 17 defined between the chamfered corner portion 8*e*, formed on the electrode 8 at the lower end thereof, and an upper end portion of the discharge flow passage 16 of the lower insulation member 10 to act as an inlet port to admit melt metal M to the discharge flow passage 16. Also, such end cutout portions 19 and openings 20 may be provided in the electrode units 1, 41 or 61 shown in FIG. 3, FIG. 4 or FIG. 6. Further, the end cutout portion 19 and the openings 20 will be generically referred to as a cutout portion in simple. Furthermore, the lower end of the electrode 8 may have no chamfered corner portion 8*e* provided that the inlet port is preferably defined only with the cutout portion.

With such a structure, the lower insulation member 10 has a portion, on the side of the cathode surface portion 15, which is formed with the cutout portion (end cutout portions 19 and openings 20) at the position in the vicinity of the gap portion 17 acting as the inlet port to admit melt metal M to the discharge flow passage 16. This enables electrolysis product metal M to be more reliably introduced into the discharge flow passage 16 of the lower insulation member 10 than that achieved in the structure merely provided with the gap portion 17. Further, providing such a cutout portion enables a reduction in the lower insulation member 10 in weight and also, permitting the upper and lower insulation members 9 and 10 to be suitably formed in hollow shapes makes the electrode unit 71 remarkably reduced in weight as a whole with the electrode unit 71 being supported in a simple and reliable manner.

As set forth above, it is of course that the upper and lower insulation members 9 and 10 need to suppress the leakage current and to rapidly move electrolysis product gas upward while contributing to an effect of rapidly moving electrolysis product metal downward. However, there is a need in that the greater the number of bipolar type electrodes with a view to increasing electrolysis performance, the lighter will be the structure. Therefore, a structure in which the upper and lower insulation members 9 and 10 are formed in lightweights will be described below.

ANOTHER MODIFIED EXAMPLES

Figure 8:
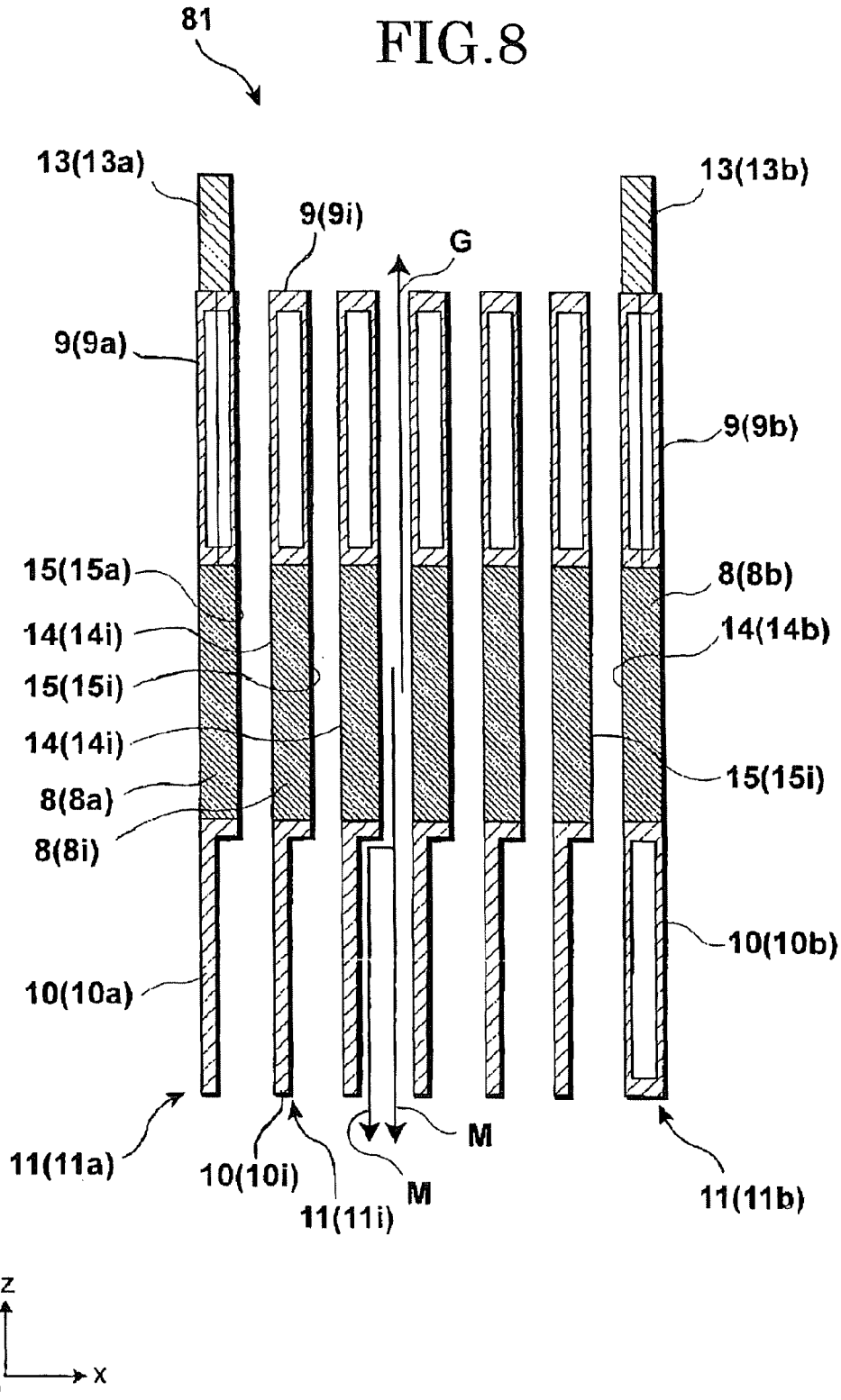
FIG. 8 is a cross-sectional view of an electrode structure body of an electrode unit of another modified example according to the present embodiment and corresponds to the cross-section taken on line A-A of FIG. 2.
Figure 9:
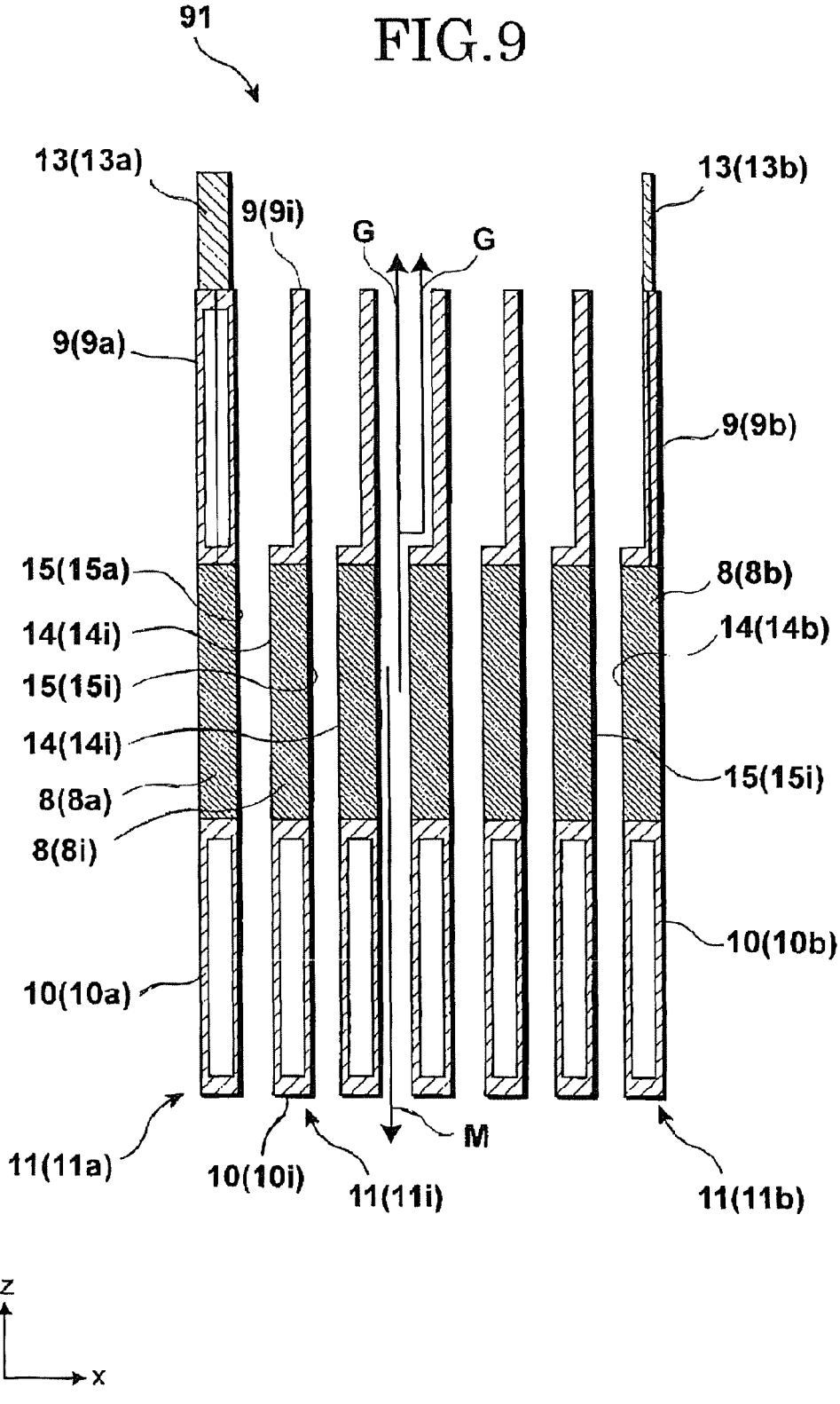
FIG. 9 is a cross-sectional view of an electrode structure body of an electrode unit of another modified example according to the present embodiment and corresponds to the cross-section taken on line A-A of FIG. 2.
Figure 10:
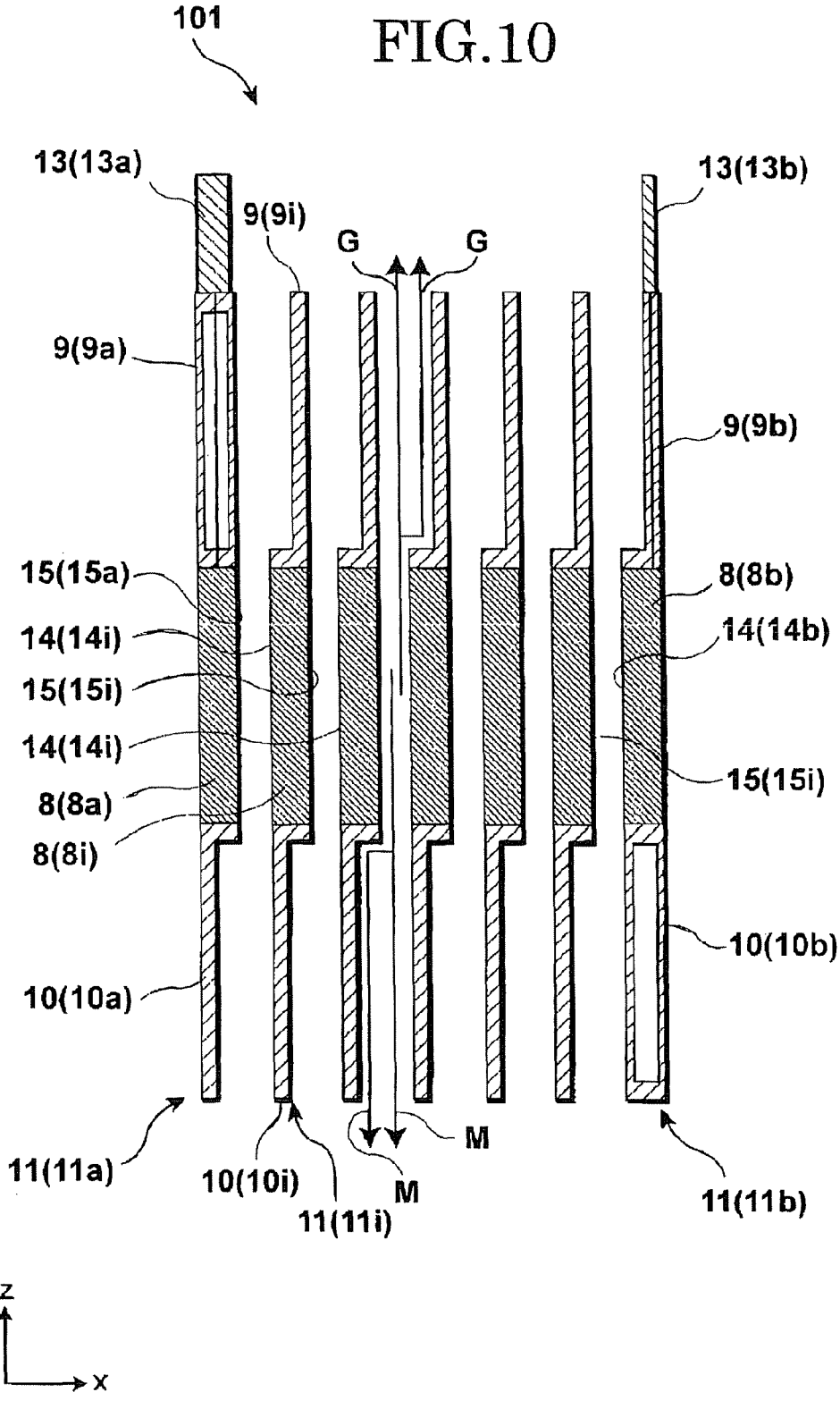
FIG. 10 is a cross-sectional view of an electrode structure body of an electrode unit of another modified example according to the present embodiment and corresponds to the cross-section taken on line A-A of FIG. 2.

FIGS. 8 to 10 are cross-sectional views of electrode structure bodies of electrode units of another modified examples according to the present embodiment and correspond to the cross-sectional view taken on line A-A of FIG. 2, respectively.

First, with the electrode unit 81 of the modified example shown in FIG. 8, the lower insulation member 10 has an upper end covering the lower end surface of the electrode 8 (i.e., an end surface parallel to the x-y plane). In addition, the lower insulation member 10 has a thickness reduced from the upper end to a lower area in an L-shaped cross-sectional configuration that is concaved on the same side as the cathode surface portion 15 to be lightweight as a whole. Further, with the electrode unit 91 of the modified example shown in FIG. 9, the upper insulation member 9 has a lower end covering the upper end surface of the electrode 8 (i.e., an end surface parallel to the x-y plane). In addition, the upper insulation member 9 has a thickness reduced from a lower end to an upper area in an L-shaped cross-sectional configuration that is concaved on the same side as the anode surface portion 14 to be lightweight as a whole.

Further, the electrode unit 101 of the modified example, shown in FIG. 10, takes a structure incorporating the upper and lower insulation members 9 and 10 formed in such L-shaped cross-sectional configurations in combination. Specifically, the upper insulation member 9 has the lower end covering the upper end surface of the electrode 8 (i.e., an end surface parallel to the x-y plane). Further, the upper insulation member 9 has the thickness reduced from the lower end to the upper area in the L-shaped cross-sectional configuration that is concaved on the same side as the anode surface portion 14 to be lightweight as a whole. Besides, the lower insulation member 10 has the upper end covering the lower end surface of the electrode 8 (i.e., an end surface parallel to the x-y plane). Further, the lower insulation member 10 has the thickness reduced from the upper end to the lower area in the L-shaped cross-sectional configuration that is concaved on the same side as the cathode surface portion 15 to be lightweight as a whole.

Here, it may suffice for the upper insulation member 9 to cover the upper end face of the associated electrode 8 and to extend upward in a compatibility to suppress the leakage current and to move electrolysis product gas upward. Also, it may suffice for the lower insulation member 10 to cover the lower end face of the associated electrode 8 and to extend downward in a compatibility to suppress the leakage current and to move electrolysis product metal downward. In place of taking the L-shaped cross-sectional configuration, therefore, a slope-shaped cross-sectional configuration may be adopted in a structure having a thickness that progressively decreases toward a distal end. Also, none of the upper and lower insulation members 9 and 10, associated with the end electrodes 8*a* and 8*b*, respectively, may have the cross-sectional configurations described above.

With a structure of such modified examples, the upper insulation member 9, having the L-shaped cross-sectional configuration that is concaved on the same side as the anode surface portion 14, has the lower end covering the upper end face of the electrode 8 while extending upward. Thus, not only the leakage current can be suppressed but also a rising region per se for electrolysis product gas G to move upward can be expanded to more reliably move electrolysis product gas upward because of the upper insulation member 9 having the surface, placed on the same side as the anode surface portion 14, which is concaved. Further, the lower insulation member 10, having the L-shaped cross-sectional configuration that is concaved on the same side as the cathode surface portion 15, has the upper end covering the lower end face of the electrode 8 while extending downward. Thus, not only the leakage current can be suppressed but also a falling region per se for electrolysis product metal M to move downward can be expanded to more reliably move electrolysis product metal downward because of the lower insulation member 10 having the surface, placed on the same side as the cathode surface portion 15, which is concaved.

With such a structure, further, as described above with reference to the third modified example, the electrodes 8 and the associated upper and lower insulation members 9 and 10 take the structure inclined at the angle of about θ with respect to the vertical direction so as to allow the anode surface portions 14 to face downward and the cathode surface portions 15 to face upward. This results in a capability of causing the movements of electrolysis product gas G and electrolysis product metal M to be strongly constrained on the anode surface portions 14 and the cathode surface portions 15, respectively, enabling electrolysis product gas and electrolysis product metal to move in a further reliable manner.

Hereunder, experimental examples of the present embodiment involving the modified examples will be described below in detail with suitable reference to the drawings.

Figure 11:
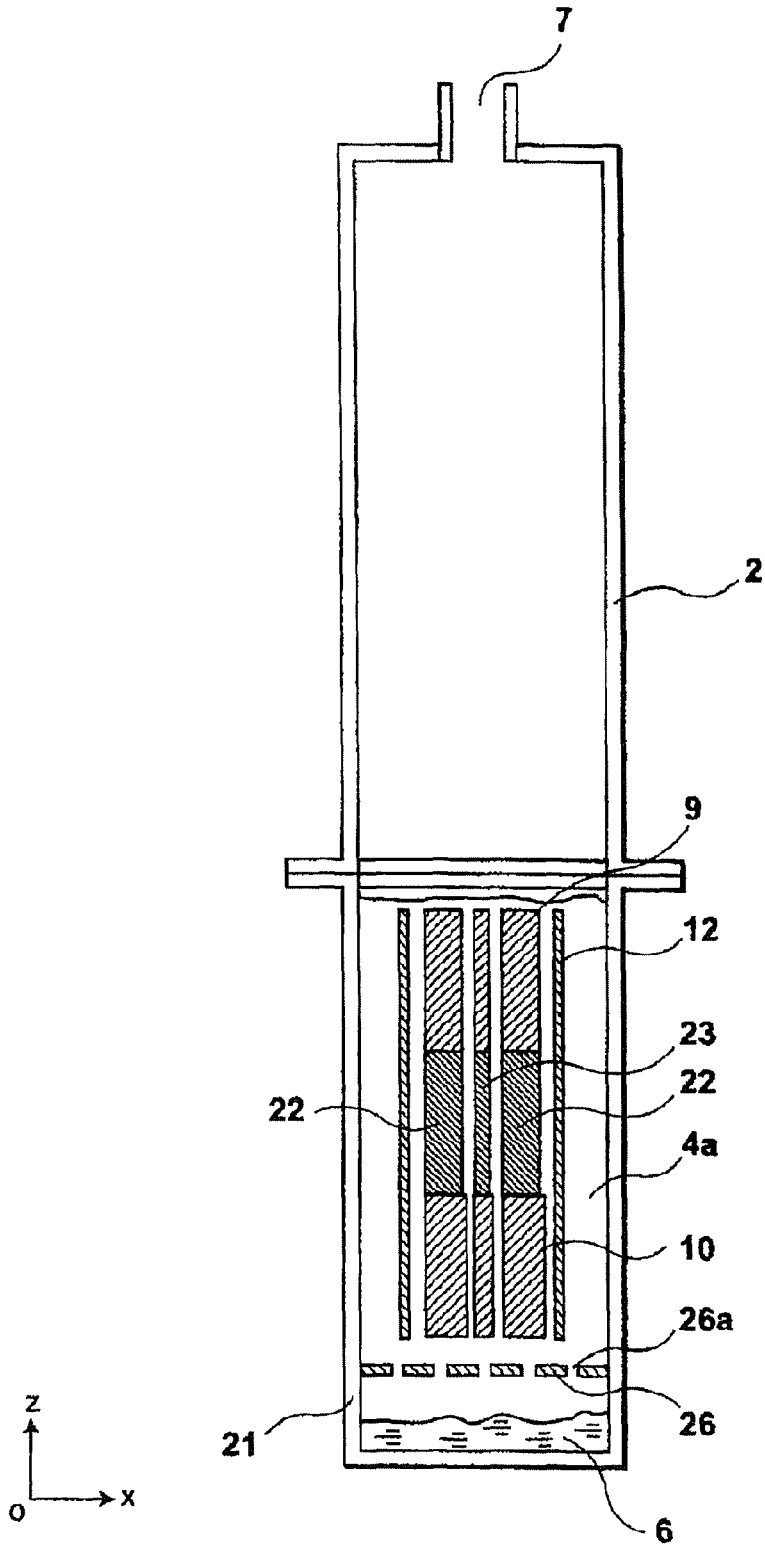
FIG. 11 is a cross-sectional schematic view of a molten salt electrolysis apparatus of an experimental example according to the present embodiment.
Figure 12:
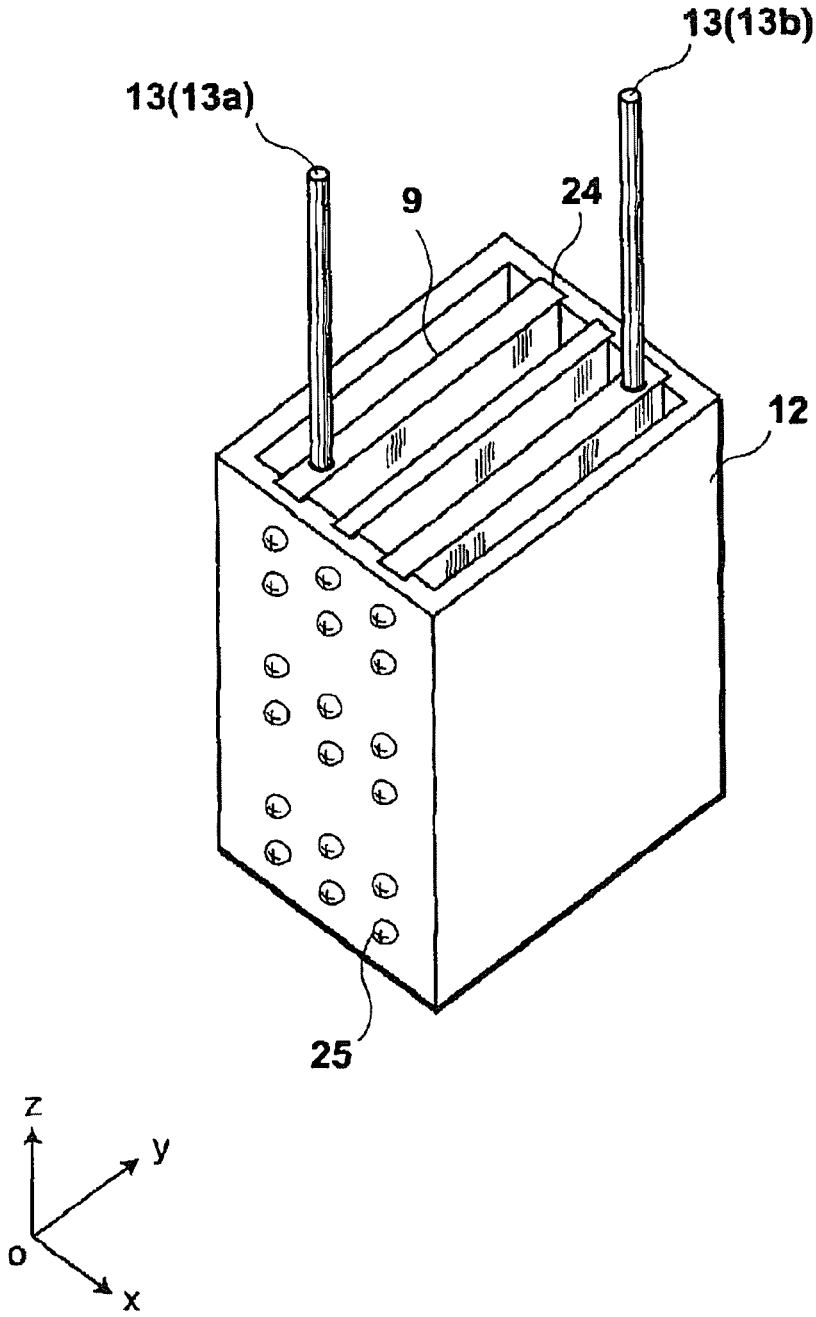
FIG. 12 is a perspective view of an electrode unit of the experimental example.

FIG. 11 is a cross sectional schematic view showing a molten salt electrolysis apparatus of an experimental example according to the present embodiment and FIG. 12 is a perspective view of an electrode unit of the present experimental example.

(Experimental Example of Present Embodiment)

With the present experimental example, as shown in FIG. 11, a cylindrical vessel, made of mild steel, was used as an electrolysis vessel 21. The electrolysis vessel 21, having one surface being closed with a diameter of 350 mm and a depth of 800 mm in the z-direction, had an inner wall formed with a mullite film with a thickness of 200 μm by plasma spray coating. The inner wall of the vessel was further applied to the mullite film with a layer of a mixture of fine powder of castable ceramic refractory (made by Toshiba Ceramic, Co. Ltd. under Trademark CASTYNA) with fibers and water in a thickness of about 500 μm and then burnt at a temperature of 900° C. for one hour to form a ceramic film.

For electrodes, further, a pair of end electrodes 22 was employed each having a size of 200 mm-by-200 mm in height and width with a thickness of 50 mm and one sheet of an intermediate electrode 23 was placed between the end electrodes 22. The intermediate electrode 23 had a size of 200 mm-by-200 mm in height and width with a thickness of 20 mm. Here, the electrodes are spaced by a distance of 5 mm and respective electrodes were connected in series in such an arrangement.

For upper and lower insulation members 9 and 10 to be fixedly attached to such electrodes 22 and 23, plate-like materials were made of castable material with fibers and subsequently sintered at a temperature of 900° C. to obtain ceramic plates, each having the same size in height and width as that of the relevant electrodes 22 and 23, which were employed. More particularly, each of the upper and lower insulation members 9 and 10 had one plane on the side of the anode surface portion (i.e., a plane on the side of the x-negative direction) to be coplanar with the corresponding anode surface portion of the electrodes 22 and 23 (i.e., a plane on the side of the x-negative direction). Likewise, each of the upper and lower insulation members 9 and 10 had the other plane on the side of the cathode surface portion (i.e., a plane on the side of the x-positive direction) to be coplanar with the corresponding cathode surface portion of the electrodes 22 and 23 (i.e., a plane on the side of the x-positive direction). That is, the neighboring upper insulation members 9 were spaced from each other by a distance of 5 mm and the neighboring lower insulation members 10 were also spaced by the distance of 5 mm.

As shown in FIG. 12, the electrodes 22 and 23, to which the upper and lower insulation members 9 and 10 are fixedly attached, were surrounded with an electrode frame 12 made of mullite with a thickness of 10 mm. The electrode frame 12 was formed with positioning grooves 24 with a view to positioning the electrodes 22 and 23 and the upper and lower insulation members 9 and 10 in place, respectively. The electrodes 22 and 23 and the upper and lower insulation members 9 and 10, positioned in the positioning grooves 24, were fixed to the electrode frame 12 by means of screws 25 made of alumina. In addition, the electrode frame 12 had an upper face and a lower face that were opened.

Further, a perforated plate 26, made of mullite, was located in the electrolyte cell 21 in an upper area with a height of 100 mm from a bottom portion of the electrolyte cell 21 as a mask member having an aperture ratio (a percentage of an area of entire openings 26*a* with respect to a total area of the perforated plate 26 when projected in the z-direction) of 30% for the purpose of preventing a leakage current to a metal liquid pool 6. Further, the electrode unit was placed such that lower ends of the lower insulation members 10 lay on an upper area with a height of 150 mm from the bottom portion of the electrolyte cell 21. Electrolyte 4*a* had a liquid surface lying on a position above upper ends of the upper insulation members 9 by a height of 30 mm. A demister 2, having the same diameter as that of a can body of the electrolyte cell 21 with a height of 1000 mm, was mounted on an upper portion of the electrolyte cell 21 to cause an outer circumferential portion to be cooled with a cooling wind at a room temperature while permitting anode product gas to be discharged from a gas outlet 7 placed in an upper area of the demister 2. The electrolyte cell 21 was heated with a heater to heat electrolyte 4*a* up to a temperature of approximately 600° C.

With such a structure, zinc chloride was introduced as electrolyte 4*a* into the electrolyte cell 21 and heated to a liquid temperature of 500° C. upon which electrolysis was conducted. During such electrolysis, electrolysis current density was 50 A/dm$^2$ with an electrolysis voltage being 8.0V (with 4.0V per one electrode set including in two sets of electrodes 22 and 23). The electrolysis voltage corresponded to the electrolysis voltage present when electrolyte per se remained at a temperature of 560° C. This represents that the temperature of electrolyte in the vicinity of the electrode unit, surrounded with the electrode frame 12, became higher than a temperature of electrolyte by a value of 60° C. and it was confirmed that the electrode frame 12 had an effect of keeping a region, in which electrolysis reaction occurred, at an appropriate temperature. Further, the leakage current remained at a value of 5% or less and it was confirmed that the leakage current was reduced to a value about one-half of a leakage current encountered with the structure in the absence of the upper and lower insulation members 9 and 10 of such structures. In this connection, calculating the current efficiency based on weight of resulting zinc correspondingly showed a value ranging from 89% to 90%. This value of the current efficiency showed the further improvement by a value of about 5% than that achieved with the structure having none of the upper and lower insulation members 9 and 10.

EXPERIMENTAL EXAMPLE OF FIRST MODIFIED EXAMPLE

In addition to the structure of the example of the present embodiment, this experimental example adopted the same structure as that of the experimental example of the present embodiment except for a structure under which each of the lower insulation members 10 increased the thickness by a value of 2 mm to have a plane on the side of the cathode surface portion (i.e., a plane on the side of the x-positive direction) so as to protrude in a distance of 2 mm in the x-positive direction with respect to the corresponding cathode surface portion of the electrodes 22 and 23 (i.e., a plane on the side of the x-positive direction). That is, the proximally neighboring upper insulation members 9 were spaced from each other by a distance of 5 mm and the proximally neighboring lower insulation members 10 were also spaced from each other by a distance of 3 mm. In addition, although not shown in any, the lower insulation members 10 had the surfaces, on the side of the cathode surface portions, which had the lower ends formed in R-shaped portions, and the lower insulation members 10 had the upper ends provided with the gap portions of about 2 mm that was acted as the inlet ports for the discharge flow passages extending through the lower insulation members 10, respectively.

Except for such differing points, upon conducting electrolysis under the same condition as that of the experimental example of the present embodiment, an electrolysis voltage was 8.0V (with 4.0V per one electrode set included in the two sets of the electrodes 22 and 23). The electrolysis voltage corresponded to the electrolysis voltage present when electrolyte remained at a temperature of 560° C. This represents that the temperature of electrolyte in the vicinity of the electrode unit, surrounded with the electrode frame 12, became higher than a temperature of electrolyte by a value of 60° C. and it was confirmed that the electrode frame 12 had an effect of keeping a region, in which electrolysis reaction occurred, at an appropriate temperature. Further, the leakage current remained at a value of 3% or less and it was confirmed that even if the lower insulation members 10 internally had the discharge flow passages, no increase in the leakage current was found and but rather a reduction occurred in the leakage current. In addition, molten zinc in the form of electrolysis product metal rapidly flowed into the discharge flow passages of the lower insulation members 10. Therefore, even though the lower insulation members 10 were spaced in a narrowed distance, no short-circuiting occurred in electric current by means of electrolysis product metal, and an electrolysis reaction could be continuously conducted in a stable manner. In this connection, calculating the current efficiency based on weight of resulting zinc resulted in a value ranging from 88% to 91%. This value of the current efficiency showed the further improvement by a value of about 10% than that achieved with the structure having none of the upper and lower insulation members 9 and 10.

EXPERIMENTAL EXAMPLE OF SECOND MODIFIED EXAMPLE

In addition to the structure of the experimental example of the first modified example, this experimental example adopted the same structure as that of the experimental example of the present embodiment except for a structure under which each of the upper insulation members 9 increased the thickness by a value of 2 mm to have a plane on the side of the cathode surface portion (i.e., a plane on the side of the x-positive direction) so as to protrude in a distance of 2 mm in the x-positive direction with respect to the corresponding cathode surface portion of the electrodes 22 and 23 (i.e., a plane on the side of the x-positive direction). That is, the neighboring electrodes 22 and 23 were spaced by a distance of 5 mm and the proximate neighboring upper insulation members 9 and the proximate neighboring lower insulation members 10 were also spaced by a distance of 3 mm.

Except for such differing points, upon conducting electrolysis under the same condition as that of the experimental example of the first modified example, an electrolysis voltage was 7.6V (with 3.8V per one electrode set included in two sets of electrodes 22 and 23) with a slight drop in contrast to that of the experimental example of the first modified example. This was because a further reduction occurred in the leakage current at portions of the upper insulation members 9 with a resultant decrease in relevant ohmic loss. Further, due to the structure under which the upper insulation members 9 were deviated in space toward the anode surface portions, a stronger upward flow of electrolyte occurred along the anode surface portions and upward flow of electrolysis product chlorine gas was promoted. As a result, a current efficiency, calculated based on resulting zinc chloride, was in a value ranging from 91% to 92% with the further improvement than that achieved with the experimental example of the first modified example.

EXPERIMENTAL EXAMPLE OF THIRD MODIFIED EXAMPLE

In addition to the experimental example of the first modified example, this experimental example adopted the same structure as that of the experimental example of the first modified example except for a structure in that of the electrodes 22 and 23, to which the upper and lower insulation members 9 and 10 were fixedly attached, were inclined at an angle of 5° so as to cause the planes on the side of the cathode surface portions (i.e., planes on the side of the x-positive direction) to face upward.

Except for such differing points, upon conducting electrolysis under the same condition as that of the experimental example of the first modified example, an electrolysis voltage was ranged from 8.1V to 8.2V. This indicated a consequence of a slight increase in electrolysis voltage than that of the first modified example but a current efficiency was found to increase as high as a value ranging from 92% to 93%. This was due to the fact that inclining the electrodes 22 and 23, to which the upper and lower insulation members 9 and 10 were fixedly attached, provided a strongly increased effect of separating zinc, in the form of electrolysis product metal, from chlorine, in the form of electrolysis product gas, so as to strongly suppress reverse reaction.

Industrial Applicability

As set forth above, the present invention provides a molten salt electrolysis apparatus and a related method that are useful in obtaining metal having a relatively low melting point like a situation when extracting melt metal mainly from a metal chloride compound, e.g., such that aluminum is produced through electrolysis of aluminum chloride. This enables a reduction in a leakage current and a remarkable increase in a current efficiency and prevents the dispersion of metal mist, a reverse reaction between product gas and product metal and a short-circuiting phenomenon between electrodes via electrolysis product metal, thereby realizing an electrolysis reaction maintained in a stable manner at high efficiency. Accordingly, such a molten salt electrolysis apparatus and a related method have expectations to be widely used in a metal production industry with the use of electrolysis.

Further, although the production of high purity silicon by a zinc reduction method is useful for production of polysilicon for a solar cell, an increasing looming issue arises in processing zinc chloride that is a by-product. Applying a molten salt electrolysis apparatus and a related method of the present invention to address such an issue results in a capability of easily decomposing a raw material, used for a zinc reduction method, into chlorine and zinc to be reused. This allows the raw material to be circulated through a system with a consequence of leading way to a closed type polysilicon production plant that is operative to achieve low consumption energy and continuous operation. Accordingly, such a melt metal electrolysis apparatus and such a related method have expectations to play a strong role in a polysilicon production industry using polysilicon as backbone materials.

The invention claimed is:

1. A molten salt electrolysis apparatus comprising:

an electrolysis vessel accommodating a melt electrolyte including a melt metal. chloride; and an electrode unit provided with electrically conductive electrodes having anode surface portions and cathode surface portions associated with the anode surface portions, first insulation members fixedly attached to upper end surfaces of the electrodes to correspondingly cover the upper end surfaces while extending upward from the upper end surfaces, second insulation members fixedly attached to lower end surfaces of the electrodes to correspondingly cover the lower end surfaces while extending downward from the lower end surfaces, and an electrode frame provided with a sidewall composed of an insulating body surrounding the electrodes to fix the electrodes, the electrode unit being immersed in the melt electrolyte while the melt electrolyte is present around the electrode frame and between the electrodes, and the second insulation members have a surface lying on the anode surface portions, which are set to be coplanar to the anode surface portions, respectively, wherein the second insulation members have a wall structure to provide flow regions allowing electrolysis product melt metal, generated at the cathode surface portions and having a specific gravity higher than that of the melt electrolyte, to flow downward, between opposed ones of the second insulation members, in parallel with or away front surfaces, at a side of the anode surface portions, of the second insulation members.

2. The molten salt electrolysis apparatus according to claim 1, wherein:

the second insulation members have flow passages through which melt metal, generated at the cathode surface portions, passes to flow down to a bottom portion of the electrolysis vessel.

3. The molten salt electrolysis apparatus according to claim 2, wherein:

the flow passages have inlets, provided in gap portions formed between lower end portions of the cathode surface portions and the second insulation members, respectively, to which melt metal, generated at the cathode surface portions, is introduced.

4. The molten salt electrolysis apparatus according to claim 3, further comprising:

at least one of chamfered corner portions, chamfered at the lower end portions of the cathode surface portions, respectively, and cutout portions, formed on the second insulation members, respectively, which are placed at the inlets of the flow passages.

5. The molten salt electrolysis apparatus according to claim 1, wherein:

at least one of the first and second insulation members have protruding portions protruding toward neighboring insulation members with respect to locations of the cathode surface portions, respectively.

6. The molten salt electrolysis apparatus according to claim 1, wherein:

the electrodes are inclined in placement with respect to a vertical direction such that the anode surface portions face downward and the cathode surface portions face upward for thereby causing gas, generated at the anode surface portions, to move upward along the anode surface portions and causing melt metal, generated at the cathode surface portions, to move downward along the cathode surface portions.

7. The molten salt electrolysis apparatus according to claim 6, wherein:

the anode surface portions and the first and second insulation members are coplanar.

8. The molten salt electrolysis apparatus according to claim 1, further comprising;

a mask member disposed between the electrolysis product melt metal, generated at the cathode surface portions and accumulated on a bottom portion of the electrolysis vessel, and the second insulation members to suppress the occurrence of a leakage current.

9. The molten salt electrolysis apparatus according to claim 1, wherein:

the electrodes are bipolar type electrodes including a pair of end electrodes and intermediate electrodes disposed between the pair of end electrodes,

10. The molten salt electrolysis apparatus according to claim 1, wherein:

the melt electrolyte is molten zinc chloride.

11. The molten salt electrolysis apparatus according to claim 1, wherein:

the electrolysis vessel is made of metal and has an internal surface covered with a ceramic layer.

12. The molten salt electrolysis apparatus according to claim 1, wherein:

the first and second insulation members are made of ceramic.

13. The molten salt electrolysis apparatus according to claim 1, wherein;

at least one of the first and second insulation members are made of ceramic with a thickness decreasing toward a distal end.

14. A method of electrolyzing molten salt comprising the steps of:

preparing a molten salt electrolysis apparatus according to claim 1; and electrolyzing the melt electrolyte to cause gas to be generated at the anode surface portions of the electrodes and melt metal to be generated with a specific gravity higher than that of the melt electrolyte at the cathode surface portions associated with the anode surface portions while decreasing an ohmic loss in the presence of the first and second insulation members.

15. The molten salt electrolysis apparatus according to claim 1, wherein:

the electrode frame has positioning grooves to correspondingly fix the electrodes.

* * * * *

UNITED STATES PATENT AND TRADEMARK OFFICE

CERTIFICATE OF CORRECTION

PATENT NO. : 8,608,914 B2
APPLICATION NO. : 12/306554
DATED : December 17, 2013
INVENTOR(S) : Takayuki Shimamune and Yoshinori Takeuchi It is certified that error appears in the above-identified patent and that said Letters Patent is hereby corrected as shown below:

In the Claims:

Claim 1, Column 22, Line 60, delete "." after "metal"

Claim 13, Column 24, Line 33, delete ";" and insert -- : --

Signed and Sealed this
Twenty-third Day of September, 2014

Michelle K. Lee

Michelle K. Lee
*Deputy Director of the United States Patent and Trademark Office*